United States Patent [19]

Kashimura et al.

[11] Patent Number: 4,699,366

[45] Date of Patent: Oct. 13, 1987

[54] AUTOMATIC SHEET FEEDING SYSTEM FOR RECORDING APPARATUS

[75] Inventors: Makoto Kashimura, Tokyo; Tetsuo Kimura, Kawasaki, both of Japan

[73] Assignee: Canon Kabushiki Kaisha, Tokyo, Japan

[21] Appl. No.: 748,569

[22] Filed: Jun. 25, 1985

[30] Foreign Application Priority Data

Jun. 28, 1984 [JP] Japan ..... 59-131920
Jun. 28, 1984 [JP] Japan ..... 59-131921

[51] Int. Cl.[4] ..... B65H 5/22

[52] U.S. Cl. ..... 271/4; 400/625; 400/629; 400/647; 271/9; 271/118; 271/209

[58] Field of Search ..... 271/3–7, 271/314, 188, 118, 9, 209, 265, 258, 259, 110, 111; 400/625, 624, 629, 641, 642, 646, 647, 647.1, 636, , 636.1, , 636.2, 604, 703

[56] References Cited

U.S. PATENT DOCUMENTS

| | | | |
|---|---|---|---|
| 3,788,636 | 1/1974 | Rehm et al. | 271/4 |
| 4,071,232 | 1/1978 | Fujmoto | 271/265 |
| 4,145,041 | 3/1979 | Kew | 271/275 |
| 4,222,557 | 9/1980 | Wu | 400/625 |
| 4,262,894 | 4/1981 | Marano | 271/4 |
| 4,268,021 | 5/1981 | Rutishauser et al. | 271/4 |
| 4,310,153 | 1/1982 | Kikuchi | 271/259 |
| 4,317,138 | 2/1982 | Bryan et al. | 271/259 |
| 4,318,540 | 3/1982 | Paananen et al. | 271/4 |
| 4,394,088 | 7/1983 | Hanamoto et al. | 271/258 |
| 4,473,314 | 9/1984 | Imaizumi | 271/3 |
| 4,564,187 | 1/1986 | Costa et al. | 271/118 |
| 4,565,462 | 1/1986 | Yamamoto et al. | 400/625 |

FOREIGN PATENT DOCUMENTS

| | | | |
|---|---|---|---|
| 0039573 | 3/1984 | Japan | 400/625 |

OTHER PUBLICATIONS

Hunt, IBM Technical Disclosure Bulletin, vol. 17, No. 4, Sep. 1974.

*Primary Examiner*—H. Grant Skaggs
*Attorney, Agent, or Firm*—Fitzpatrick, Cella, Harper & Scinto

[57] ABSTRACT

There is disclosed a simplified sheet feeding system for a recording apparatus such as copier. A sheet is pinched between ribs projecting on a sheet guiding face and driven feed rollers which are movable in position and partly overlap with the projecting ribs when the sheet is absent.

12 Claims, 38 Drawing Figures

| | |
|---|---|
| FIG.17A | |
| FIG.17B | FIG.17C |

| FIG.18A | FIG.18B |
|---|---|
| FIG.18C | |

AUTOMATIC SHEET FEEDING SYSTEM FOR RECORDING APPARATUS

BACKGROUND OF THE INVENTION

1. Field of the Invention

The present invention relates to an automatic sheet feeding system for automatically feeding cut sheets to a recording unit for image recording on the cut sheets.

2. Description of the Prior Art

In general, recording apparatus uses a continuous sheet such as a fan-fold sheet, or separate cut sheets. In case of continuous sheet, once it is loaded, no further sheet loading is required. On the other hand, cut sheets have to be fed into the recording apparatus one by one and an automatic sheet feeding mechanism is desirable.

In such automatic sheet feeding mechanism, for example a cut sheet feeder employed in conventional printers as shown in FIG. 1, the sheet feeding is effected by rotating a feed roller 201 as by a motor, while the sheet discharge is effected by a discharge roller 204 linked with a sheet advancing roller 202 in the printer. More specifically, in FIG. 1, the sheet advancing roller 202 is linked with the discharge rollers 204 for example through an unrepresented belt whereby the latter roller is rotated by the former. In such case a cut sheet 203 is fed toward the discharge rollers 204 with the progress of the printing operation from the contact point of a first pinch roller 206 and the advancing roller 202, while sheet discharge is effected by pinching the sheet with two discharge rollers 204. There are also shown a printer 205, an automatic sheet feeder 210, a recording head 212, and a second pinch roller 214.

The sheet finally leaves the discharge rollers 204 and is discharged to a tray 208. In this operation, however, sheet jamming may occur as the lower end of the sheet 203 tends to be retained between the discharge rollers 204.

Also in case the discharge rollers 204 are rotated by the sheet advancing roller 202, they have to be rotated even during mere sheet advancement or sheet discharge, thus requiring a large motor with a significant power loss.

Also the continuous rotation of the sheet advancing roller and the discharge rollers may result in a slack or a skewed advancement of the cut sheet unless these rollers are mutually synchronized, and such synchronization leads to a complicated structure and an elevated cost of the apparatus.

In case a cut sheet feeder is adopted, it is still desirable that the operator can manually load cut sheets one by one into the recording apparatus. For this purpose there are conventionally provided an exclusive selector switch for selecting an automatic sheet feed mode and a manual sheet feed mode and an aperture for inserting a cut sheet, and the operator is required to insert a cut sheet into the aperture after the selector switch is properly manipulated. In such structure, however, there results a danger of the cut sheet being manually inserted without proper shifting of the selector switch.

Also the conventional cut sheet feeder is provided with an exclusive sheet detecting switch, and the recording apparatus controls the feeder and determines the timing of sheet feeding in response to the detection by the switch. Such method not only requires an exclusive detecting switch but also an exclusive signal processing program responding to the switch in the recording apparatus, thus increasing the load to the control system therein.

Besides such conventional cut sheet feeder is provided with a feed start switch and other switches. Such arrangement not only requires exclusive switches but again needs exclusive programs for such switches in the recording apparatus, thus increasing the load of the control system thereof.

Furthermore, such conventional cut sheet feeder is often equipped with exclusive alarm means for indicating the absence of recording sheet or sheets jamming. In such conventional feeder, exclusive programs for activating such alarm means have to be provided in the recording apparatus, thus increasing the load to the control system thereof.

Furthermore, a conventional cut sheet feeder is provided with separate switches respectively for detecting the absence of recording sheets and sheet jamming. Such structure, involving plural detecting switches, requires a complicated circuitry increasing the load on the control system of the recording apparatus.

Also the conventional cut sheet feeder is provided with an exclusive switch for detecting sheet jamming, but the presence of such a switch complicates the structure and increases the load on the control system of the recording apparatus.

Furthermore the conventional cut sheet feeder is either unable to detect the absence of recording sheets or requires an exclusive detecting switch for such detection, which inevitably complicates the structure and increases the load on the control system of the recording apparatus.

Furthermore, in the conventional structure, the recording apparatus is provided with a motor for rotating the sheet advancing roller while the cut sheet feeder is provided with a motor for rotating a sheet feeding roller or a sheet discharge roller, and these motors are simultaneously in motion for a certain period. Consequently there is required a power source of a large capacity for driving these motors.

SUMMARY OF THE INVENTION

An object of the present invenion is to provide an automatic cut sheet feeding system for use in a recording apparatus, capable of securely discharging cut sheets.

Another object of the present invention is to provide an automatic cut sheet feeding system that is capable of avoiding a power loss in motors which enables the use of small motors.

Still another object of the present invention is to provide an automatic cut sheet feeding system in which a sheet discharge roller need not be synchronized with the sheet advancing operation in the recording apparatus, so that the structure can be simplified.

Still another object of the present invention is to provide an automatic cut sheet feeding system enabling secure feeding of cut sheets by manual insertion.

Still another object of the present invention is to provide an automatic cut sheet feeding system in which a sheet detecting switch of the recording apparatus is also used as the sheet detecting switch for the cut sheet feeder.

Still another object of the present invention is to provide an automatic cut sheet feeding system in which an operation switch of the recording apparatus is also utilized as the operation switch for the cut sheet feeder.

Still another object of the present invention is to provide an automatic cut sheet feeding system in which alarm means of the recording apparatus is also utilized as the alarm means for the cut sheet feeder.

Still another object of the present invention is to provide an automatic cut sheet feeding system in which a switch is utilized both for detecting the absence of recording sheets and for detecting sheet jamming.

Still another object of the present invention is to provide an automatic cut sheet feeding system in which a sheet detecting switch of the recording apparatus is utilized also as a sheet jam detecting switch for the cut sheet feeder.

Still another object of the present invention is to provide an automatic cut sheet feeding system in which a detecting switch of the recording apparatus is also utilized as a switch for detecting the absence of the recording sheet in the cut sheet feeder.

Still another object of the present invention is to provide an automatic cut sheet feeder which allows the use of small motors, thereby enabling reduction of the capacity of the power source.

The foregoing and other objects of the present invention, and the advantages thereof will become fully apparent from the following description.

BRIEF DESCRIPTION OF THE DRAWINGS

FIGS. 3 to 6A–6C illustrate another embodiment of the present invention and respectively are a lateral cross-sectional view, a plan view, a partial enlarged view of the essential part and a schematic view showing the function of a sheet discharge roller of an automatic cut sheet feeder;

FIG. 10 and insuring drawings illustrate still another embodiment, wherein;

FIG. 10 is a lateral view of an automatic cut sheet feeder constituting another embodiment;

DETAILED DESCRIPTION OF THE PREFERRED EMBODIMENTS

Now the present invention will be clarified in detail by embodiments thereof shown in the attached drawings.

Figure 1:
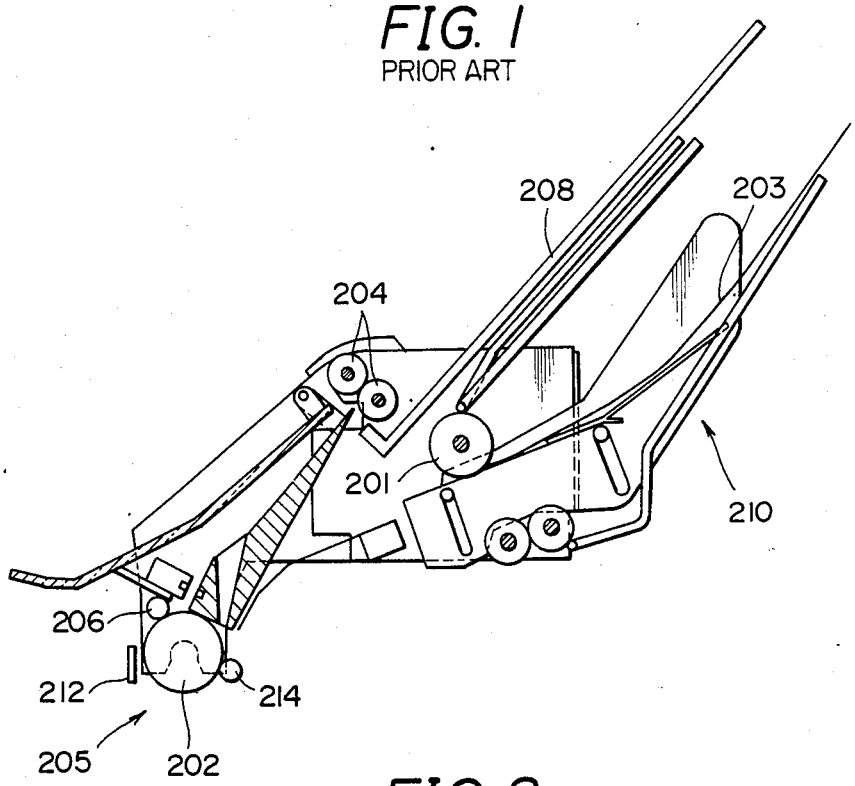
FIG. 1 PRIOR ART
FIG. 1 is a schematic view of a conventional printer and cut sheet feeder.
Figure 2:
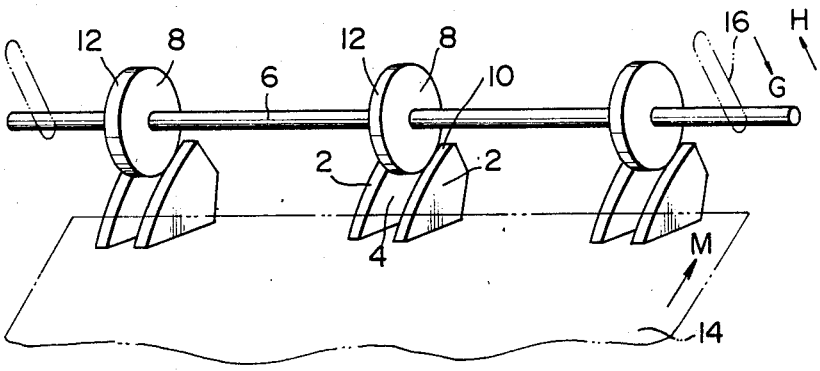
FIG. 2 is a perspective view of a sheet discharge mechanism in an automatic cut sheet feeder constituting an embodiment of the present invention.

FIG. 2 is a schematic view of a sheet discharge mechanism embodying the present invention, wherein a support plate constituting a part the housing of an unrepresented automatic cut sheet feeder is provided with three pairs of guide ribs 2 in parallel manner, and discharge rollers 8, mounted on a roller shaft 6 are provided in such a manner that each discharge roller 8 faces a groove 4 between corresponding pairs of guide ribs 2 and the external periphery 12 of the discharge roller 8 is tangential to a plane formed by the upper surfaces of the guide ribs 2.

The function of the above-described mechanism is as follows. A cut sheet 14 is advanced in a direction M by a sheet advancing roller of an unrepresented recording apparatus or printer, and when the discharge rollers 8 are activated, the cut sheet is further advanced in the direction M by the rotation of the rollers 8, while being pinched between the rollers 8 and the guide ribs 2.

Figure 3:
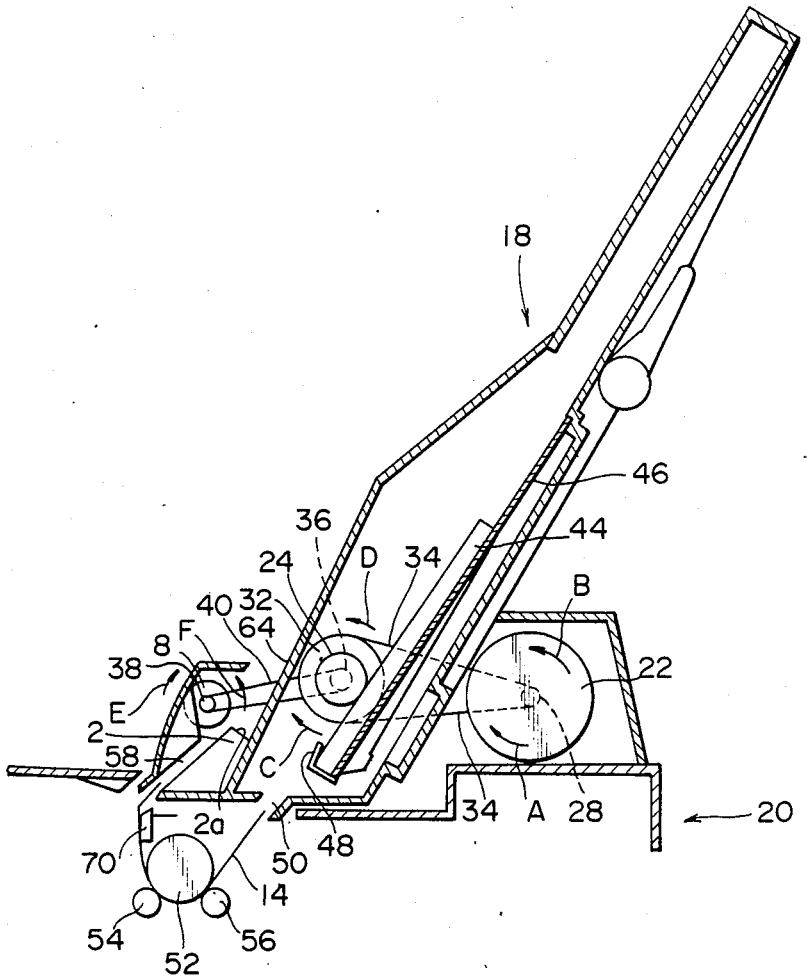
Figure 4:
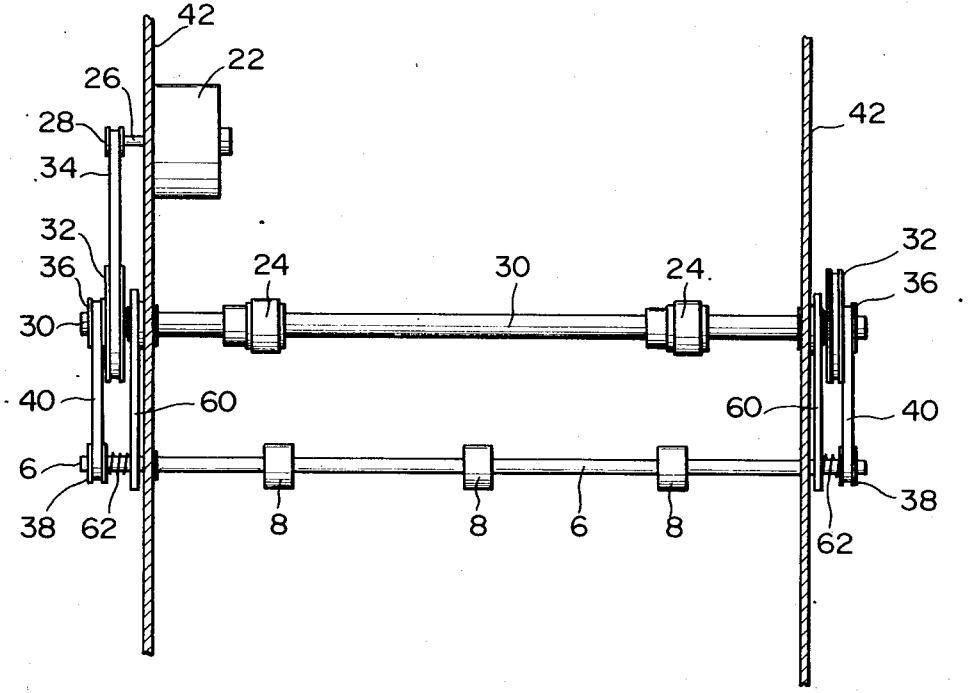
Figure 5:
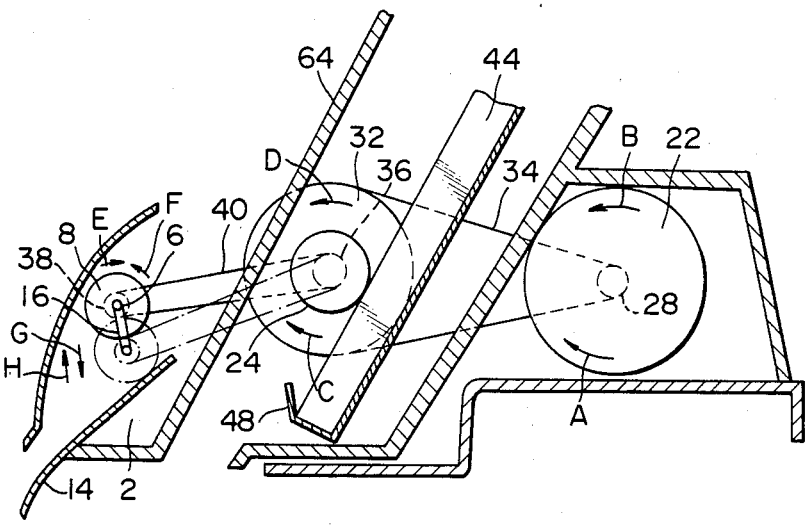

Also as shown in FIG. 2, unrepresented lateral boards of the automatic cut sheet feeder are provided with guide grooves 16 which are extended in a direction substantially perpendicular to the sheet discharging direction M and in which the discharge roller shaft 6 is rendered movable, whereby the discharge rollers 8 are moved in a direction G only during the sheet discharging operation to pinch the cut sheet 14 between the peripheries 12 of the discharge roller 8 and the upper surfaces 10 of the guide ribs 2, but are lifted in a direction H by unrepresented springs in other instances. FIGS. 3 to 5 illustrate an example of the automatic cut sheet feeder with the guide grooves in the lateral boards as an embodiment of the present invention, and are, respectively, a schematic lateral cross-sectional view, a schematic plan view and a partial enlarged view of an essential part.

As shown in FIG. 3, the automatic cut sheet feeder 18 is detachably mounted on a printer 20, and is provided with a motor 22 rotatable in forward or reverse direction, a sheet feeding roller 24 and a sheet discharge roller 8, both of which are driven by the motor 22. More specifically, as shown in FIG. 4, a first belt 34 is provided between a motor pulley of a motor shaft 26 and a first sheet feed pulley 32 of a sheet feed roller shaft 30, and a second belt 40 is provided between a second sheet feed pulley 36 of the sheet feed roller shaft 30 and a sheet discharge pulley 38 of a sheet discharge roller shaft 6. Each lateral board 42 of the automatic cut sheet feeder 18 is provided with a guide groove 16 (FIG. 5) which extends in a direction substantially perpendicular to the discharge direction of the cut sheet 14 and in which the discharge roller shaft 6 is slidably supported.

In FIG. 3 there are also shown a stack of cut sheets 44; a pressure plate 46 for supporting and pressing the sheet stack 44 against the sheet feed roller 24; a separating finger 48; a sheet feeding slot 50; a sheet advancing roller 52 functioning also as a platen in the printer 20; first and second pinch rollers 54, 56; and a sheet discharge slot 58. In FIG. 4 there are shown swinging levers 60 rotatably supporting the sheet discharge rollers 8; and a spring 62.

A front plate 64 (FIG 5) of the automatic cut sheet feeder 18 of the above-described structure is provided with three pairs of guide ribs 2, and the sheet feed roller shaft 30 is so positioned that each of the sheet feed rollers 24 faces a gap between paired ribs 2.

Between each of the sheet feed rollers 24 and the sheet feed roller shaft 30 there is provided an unrepresented one-way clutch for the following purposes:

(1) In the normal sheet feed, the rotation of the sheet feed roller shaft 30 is directly transmitted to the sheet feed rollers 24;

(2) While the motor 22 is deactivated for printing operation on the printer, the cut sheet is advanced by the sheet advancing roller of the printer but the trailing end of the cut sheet is still in contact with the sheet feed rollers 24 to rotate the same in the forward direction by friction, but the forward rotation is not transmitted to the sheet feed roller shaft; and (3) In the sheet discharge, the motor 22 is reversed so that the sheet feed roller shaft 30 is also rotated in the reverse direction, but the reverse direction is not transmitted to the sheet feed rollers 24.

In summary, in the above-described embodiment, the pressure plate 46 constitutes a sheet storage unit for the sheet stack 44. As a consequence of forward rotation of the motor 22, sheet feed means composed of sheet feed rollers 24, supplies a cut sheet between a sheet advancing roller 52 and pinch rollers 56, 54 constituting sheet advancing means of the printer. The sheet advancing roller 52 and pinch rollers 56, 56 advance the cut sheet 14 toward the discharge roller 8 through a position in front of a recording head 70 that effects recording on the sheet. After recording by the recording head, the cut sheet is pinched by the discharge rollers 8 and guide ribs 2 for discharge in the upward direction, and is disposed in such a manner that its lower end lies on the upper slanted portions of the ribs 2. In this manner the sheet is stored in a discharged sheet storage unit composed of the front plate 64 and the upper slanted portions of the guide ribs 2.

Figures 6A, 6B, 6C:
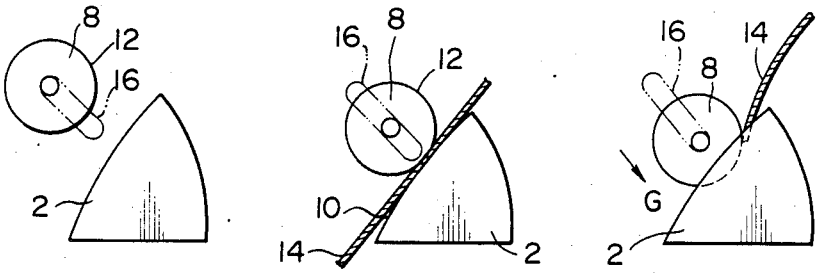

In the following there will be given a detailed explanation on the function. In the sheet feeding operation, the motor 22 is rotated in a direction A shown in FIG. 5, whereby the sheet discharge rollers 8 are rotated, through the first belt 34, first sheet feed pulley 32, second sheet feed pulley 36 and second belt 40, in a direction E, and at the same time the sheet discharge rollers 8, an intermediate lever 60 and second belt 40 are integrally lifted in a direction H by the tension of the second belt 40, as shown in FIG. 6(A).

In this state the sheet feed roller shaft 30 is rotated in a direction C, and the rotation is transmitted to the sheet feed rollers 24 by the function of the one-way clutches.

By the rotation of the sheet feed rollers 24 in the direction C, an uppermost sheet in the sheet stack 44 is disengaged from the separating finger 48, and, due to rotation of the sheet feed rollers 24, is advanced to a contact point between the sheet advancing roller 52 and the second pinch roller 56 of the printer 20. When the leading end of the sheet 14 reaches the contact point, the motor 22 is stopped and the sheet advancing roller 52 is driven by an unrepresented driving source whereby the sheet 14 advances between the first pinch roller 54 and sheet advancing roller 52, printed in the printer 20 and is forwarded to the discharge slot 58.

Though the motor 22 is stopped during this operation, the trailing end part of the sheet 14 remains in contact with the feed rollers 24 to rotate the same in a direction C by friction with the sheet 14 during advancement thereof; however, because of the operation of unrepresented one-way clutches, the sheet feed roller shaft 30 is not rotated and the feed rollers 24 are idling.

When the trailing end of the sheet 14 reaches the contact point between the sheet advancing roller 52 and the first pinch roller 54, said advancing roller 52 is stopped and the motor 22 is put into reverse rotation in a direction B. Said rotation is transmitted through the first belt 34, first sheet feeding pulley 32, second sheet feeding pulley 36 and second belt 40 to the discharge pulley 38 whereby the sheet discharge rollers 8 are rotated in a direction F. In response to said rotation in the direction F, due to the tension of the second belt 40, the sheet discharge rollers 8, intermediate lever 60 and second belt 40 are integrally lifted in a direction G shown in FIG. 5. In this state, as shown in FIG. 6(B), the sheet 14 is present between the upper faces of the ribs 2 and the peripheries 12 of the sheet discharge rollers 8 whereby the sheet discharge rollers 8 press and advance the sheet 14. When the trailing end of the sheet 14 comes into contact with the sheet discharge rollers 8 at the end of advancement of the sheet 14 (FIG. 6(C)), the sheet discharge rollers 8 descend, by the weight thereof, toward the lower end G of the guide groove 16 whereby the sheet discharge roller shaft 6 is stopped at the lower end of the guide groove 16. The trailing end of the sheet 14 is smoothly discharged by the descent of the sheet discharge rollers 8.

During the discharge of the sheet 14, the sheet feeding roller shaft 30 is also rotated in the reverse direction D, but the sheet feeding rollers 24 are not rotated by the function of the one-way clutches, thus preventing the reverse advancement of the sheet.

The selection of forward or reverse rotation of the motor 22 and the activation of the sheet advancing roller 52 are achieved by a control unit in response to signals from unrepresented sensors.

In the foregoing embodiment the power transmission from the motors is achieved by belts, but it is naturally possible to employ gears or other means.

The foregoing embodiment employs three pairs of ribs and three sheet discharge rollers, but it is naturally possible to employ these elements in other numbers.

Figure 7:
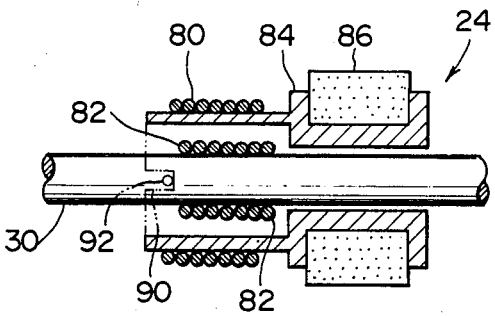
FIGS. 7 to 9 illustrate a sheet advancing roller and a one-way clutch and respectively are a cross-sectional view, a perspective view and another perspective view.
Figure 8:
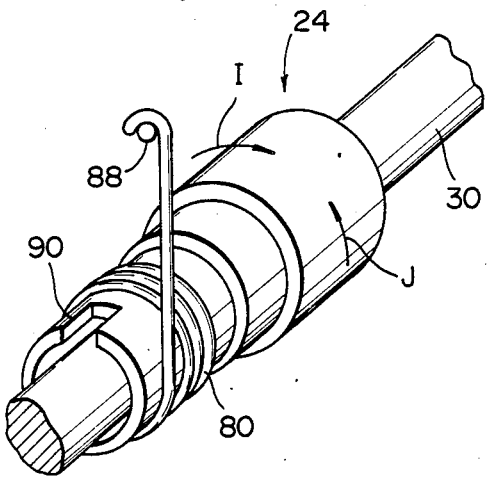
Figure 9:
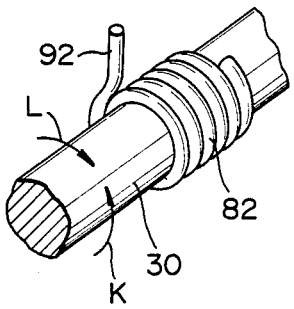

FIGS. 7 to 9 show details of the sheet feeding rollers 24 and one-way clutches. The sheet feeding roller 24 is composed of a molded member 84 and a rubber member 86 for contact with the sheet, and the molded member 84 is rendered rotatable to the sheet feeding roller shaft 30. Around the molded member 84, there is provided a first spring clutch 80 of a diameter slightly smaller than the external diameter of the molded member 84. Because of such diameter relationship, the first spring clutch 80 is radially compressible against the molded member 84. An end of the first spring clutch 80 engages with a part 88 of the automatic cut sheet feeder (FIG. 8) while the other end is left free.

As viewed the left end of the molded member 84 is notched as it 90. Around the sheet feeding rolling shaft 30 there is provided a second spring clutch 82, as shown in FIG. 9. The diameter of that clutch is also slightly smaller than the external diameter of the sheet feeding roller shaft 30. The second spring clutch 82 is radially compressible against the shaft 30. The second spring clutch 82 has a radially extended end 92 engaging with the notch 90 of the molded member 84 as shown in FIG. 7, and the other end is left free.

As shown in FIG. 8, the first spring clutch 80 allows the sheet feeding roller 24 to rotate only in one direction. When the sheet feeding roller 24 starts to rotate in the reverse direction I, the first spring clutch 80 is tightened, with an end thereof fixed to a part 88 of the automatic cut sheet feeder, to lock the sheet feeding roller 24. However the sheet feeding roller 24 can freely rotate in a direction J as the first spring clutch 80 is loosened.

The second spring clutch 82 transmits the rotation of the sheet feeding roller shaft 30 in only one direction to the sheet feeding roller 24. When the sheet feeding roller shaft 30 is rotated in the forward direction K, the second spring clutch 82 is tightened to transmit the rotation to the sheet feeding roller 24. If the sheet feeding roller 24 is rotated in the forward direction J while the roller shaft 30 is stopped, the second spring clutch 82 is loosened so that the roller shaft 30 is not rotated. Also in case the sheet feeding roller shaft 30 is counter rotated in a direction L, the first spring clutch is tightened but the second spring clutch is loosened, so that the molded member 84, and consequently the sheet feeding roller 24 is not rotated.

Figure 10:
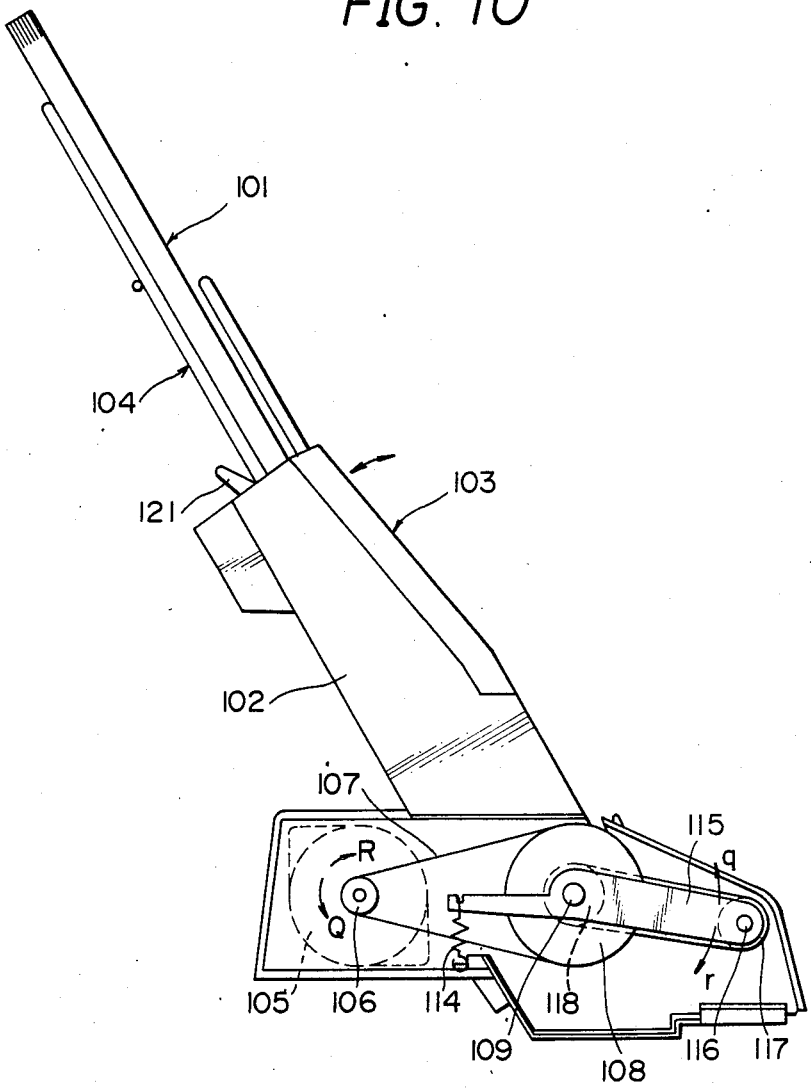

In FIG. 10, showing the entire structure of a cut sheet feeder, a stack 101 of cut sheets shown placed between a paper holder 102 and a front cover 103 freely openable in a direction of the arrow from said paper holder 102, and the upper end of the stack 101 is supported by a hopper 104.

Figure 11:
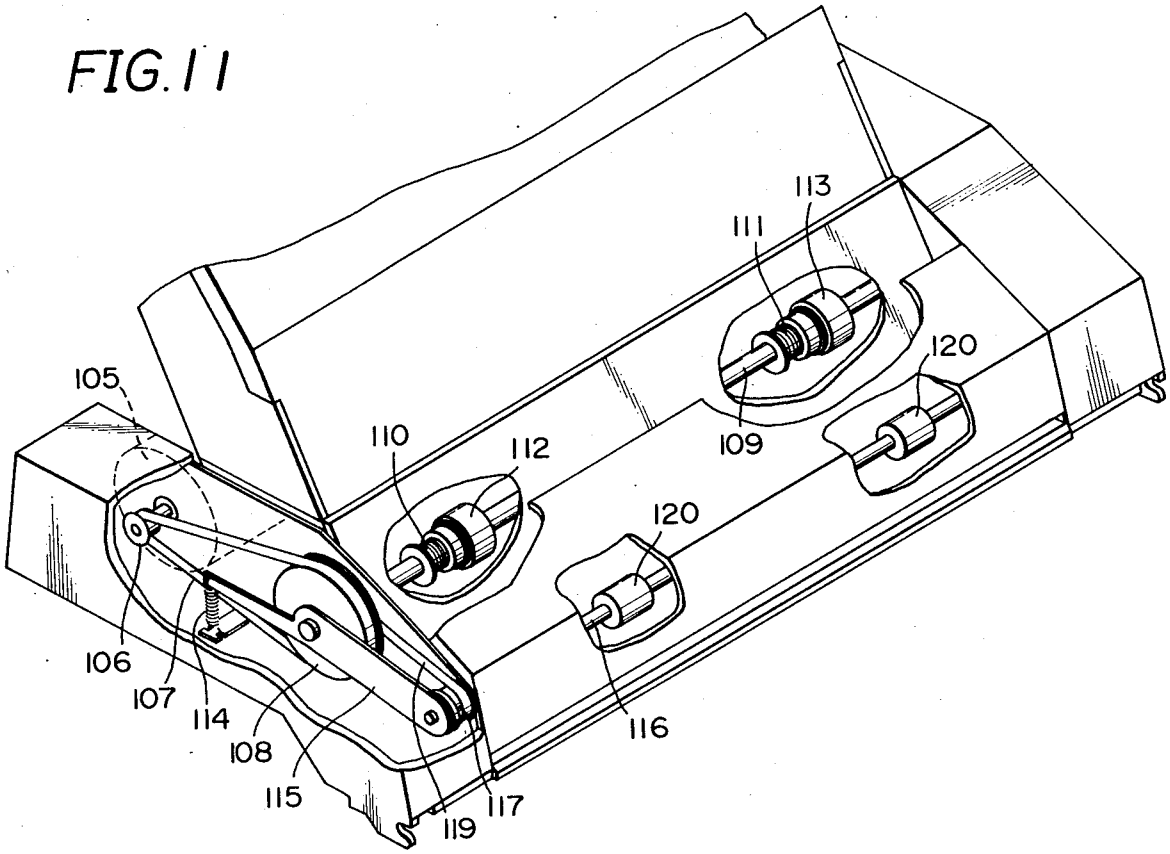
FIG. 11 is a partially cut-off perspective view of FIG. 10.

In the lower part of the cut sheet feeder there is formed a feed and discharge unit powered by a motor 105. In FIG. 11, a stepping motor 105 is shown mounted in a left rear position, and linked to a sheet feeding pulley 108 through a motor pulley 106 and a timing belt 107. The sheet feeding pulley 108 is fixed to and rotates always integrally with a sheet feeding shaft 109 rotatably supported by two lateral plates of the cut sheet feeder. The sheet feeding shaft 109 supports, through one-way clutches 110, 111, sheet feeding rollers 112, 113 which rotate only when the motor 105 is rotated in one direction.

The sheet feeding shaft 109 rotatably supports a lever 115 an end of which is supported by a spring 114 to suspend the other end thereof. Though only one lever at the left-hand side is illustrated, there is also provided a similar lever 115 at the right-hand side. These paired levers 115 are both rotatably supported by the sheet feeding shaft 109 and are rotatably supported, at the other end by a sheet discharge shaft 116.

On both ends of the sheet discharge shaft 116, close to the levers 115 there are fixed sheet discharge pulleys 117, powered through timing belts 119 from small pulleys 118 (FIG. 10) integrally rotating with the sheet feeding pulley 108. In this way, pulleys 117 always rotate with the motor 105. The sheet discharge shaft 116 supports sheet discharge rollers 120 that are affixed thereto.

Figure 12:
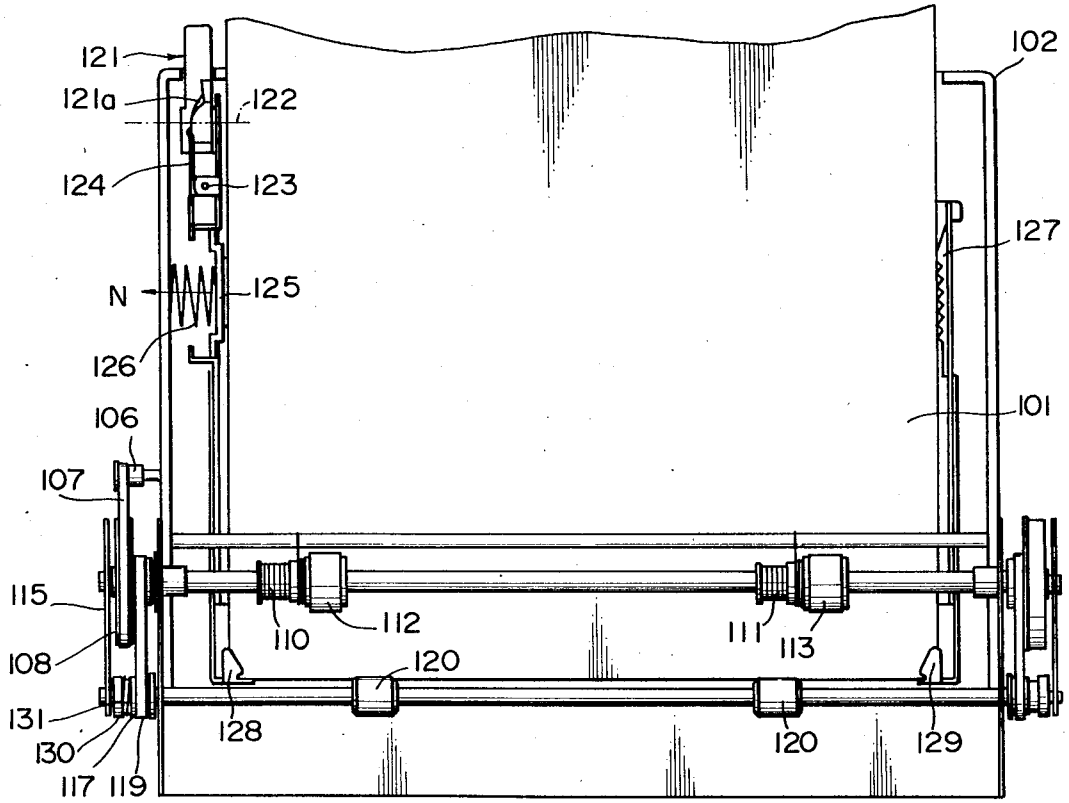
FIG. 12 is an elevation view of FIG. 10.

FIG. 12 is a view of the cut sheet feeder seen from the front. At the upper left end of the paper holder 102, a release lever 121 is rotatably mounted about an axis 122. The release lever 121 is provided with a cam face 121*a* and engages with a release arm 124 rotatably mounted about an axis 123. A lateral support member 125 for supporting the left lateral face of the stack 101 of the cut sheets engages the release arm 124 and is biased toward the stack 101 by a spring 126. On the opposite side there is provided a paper guide member 127 for supporting the right lateral face of the stack 101 of the cut sheets.

In the above-described structure, when the release lever 121 is pulled toward the front in FIG. 12, the lateral support member 125 is moved in a direction N through the release arm 124, whereby the stack 101 of the cut sheets is released from restraint in the lateral direction. In this manner the removal or replacement of the stack 101 is rendered possible.

The lower end of the sheet stack 101 is supported, at both ends thereof, by separating fingers 128, 129 similar to those employed in a sheet cassette of a copier.

Between the sheet discharge pulley 117 and the lever 115 there are provided a felt member 130 of high friction and a spring 131 for biasing the felt member 130 toward the lever 115, in order to bias the lever 115 to a determined position by the rotation of the motor 105 as will be explained later.

Figure 13:
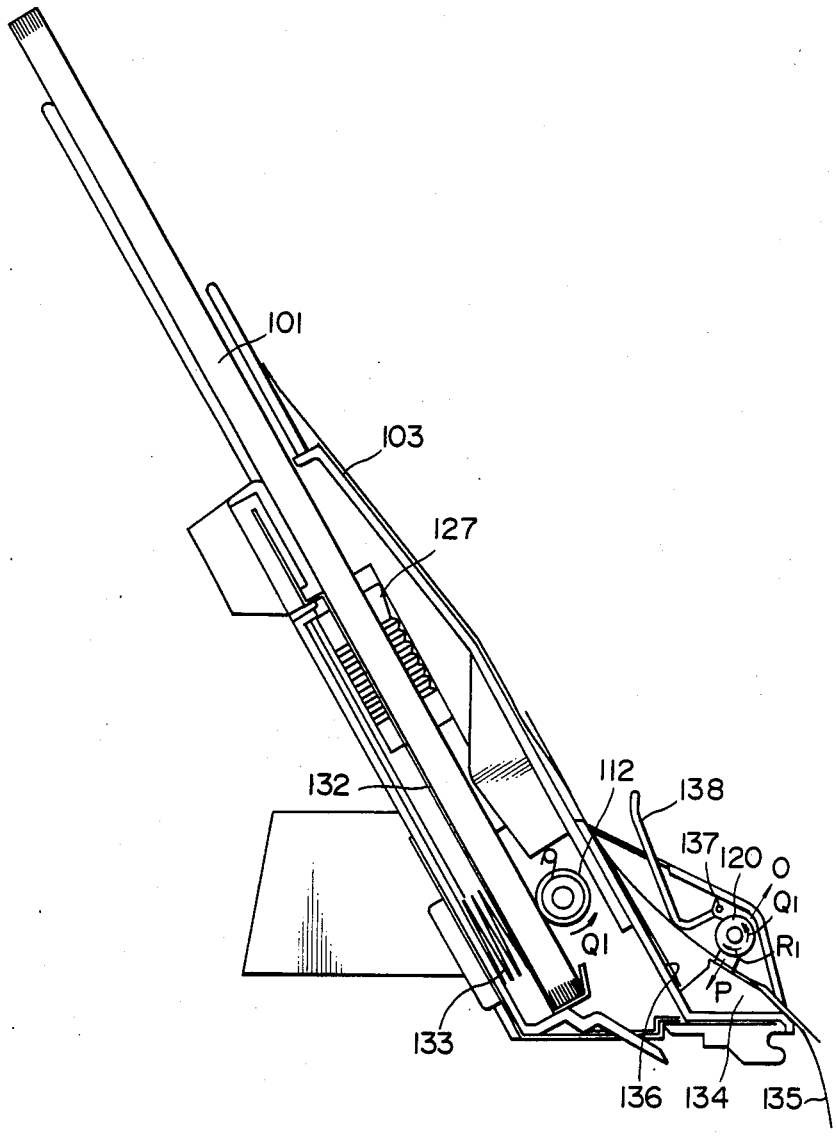
FIG. 13 is a cross-sectional view of FIG. 10.

FIG. 13 is a cross-sectional view of the cut sheet feeder, wherein the cut sheet stack 101 is placed on an intermediate plate 132. A spring 133 presses the lower part of the intermediate plate 132 toward the sheet feeding rollers 112, whereby an uppermost sheet in the stack 101 is always in contact with the sheet feeding rollers 112.

The sheet discharge rollers 120 are positioned above guide ribs 134 for the discharged sheet and are movable in a direction O or P.

When the motor 105 is rotated in a direction Q in FIG. 10 in the above-described cut sheet feeder, the one-way clutches 110, 111 are activated to rotate the sheet feeding rollers 112, 113 in a direction Q1 shown in FIG. 13, thereby advancing an uppermost sheet of the stack 101 toward a printer located below. The rotation of the motor 105 shifts the levers 115 in the direction O to lift the sheet discharge rollers 120 from the guide ribs 134, so that the cut sheet 135 discharged from the printer cannot be pushed back into the printer in spite of the rotation of the sheet discharge rollers 120 in a direction R1 (FIG. 13).

When the motor 105 is rotated in a direction R in FIG. 10, the sheet feeding rollers 112, 113 are not rotated as the one-way clutches 110, 111 are deactivated. On the other hand, the levers 115 are shifted in a direction r, whereby the discharged cut sheet 135 is pinched between the sheet discharge rollers 120 on the one hand and the guide ribs 134 on the other hand, and is discharged to a discharged sheet tray 136 by the rotation of the sheet discharge rollers 120 in a direction R1. A sheet support member 138, rotatable about an axis 137, presses the discharged cut sheet to form a neat sheet stack on the tray.

In the foregoing there has been explained the function in an automatic sheet feed mode. The cut sheet feeder of the present embodiment is also provided with a manual feed mode, in which the cut sheets are manually supplied.

Figure 14:
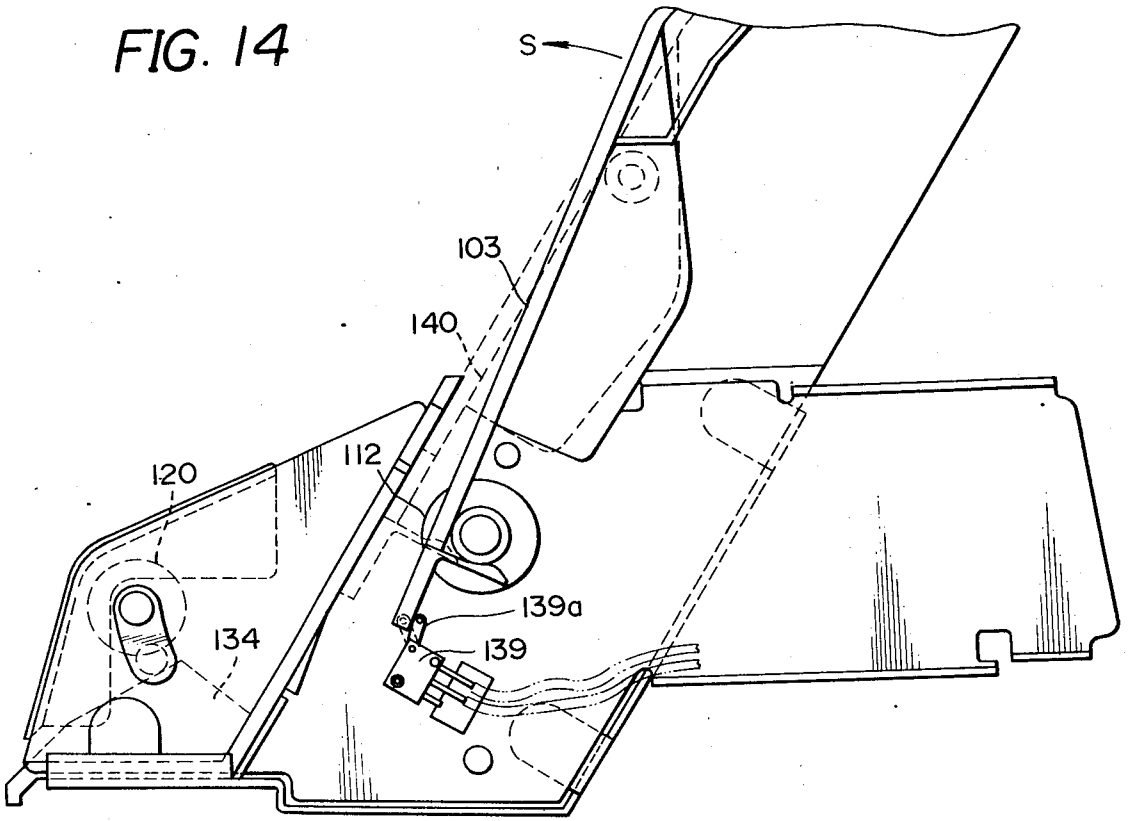
FIG. 14 is a lateral cross-sectional view thereof.

FIG. 14 shows the manual feed mode wherein the front cover 103 is pulled in a direction S. In this manner, the lower end of the front cover 103 actuates an actuator 139*a* of a mode switch 139 mounted on the casing of the cut sheet feeder, thus turning on the switch 139. The output signal thereof is transmitted to the printer through an unrepresented cable, thus indicating to the printer that the manual feed mode has been adopted. Also a manual feed slot 140 is formed by the movement of the front cover 103, thus enabling the insertion of a cut sheet. The cut sheet inserted from the manual feed slot is guided to a position between the platen of the printer and the pinch rollers thereof. The details of the printer are the same as in the foregoing embodiment and are therefore not explained further.

ELECTRIC STRUCTURE

Figure 15A:
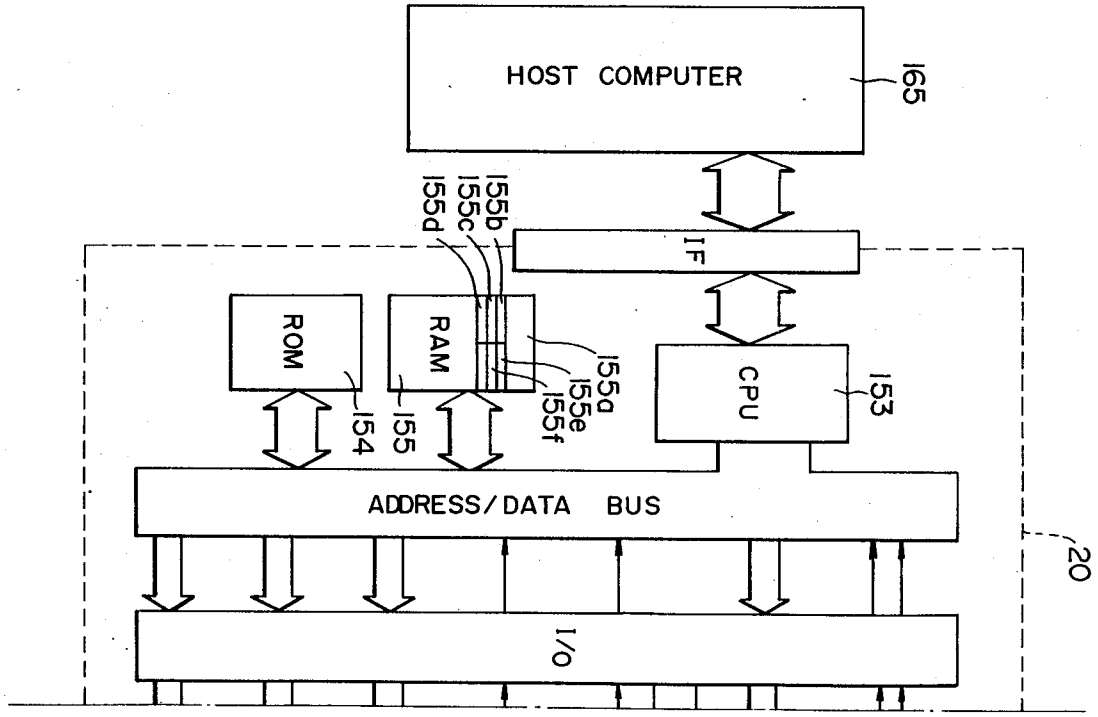
FIGS. 15A and 15B show a block diagram of the circuitry for either embodiment.
Figure 15B:
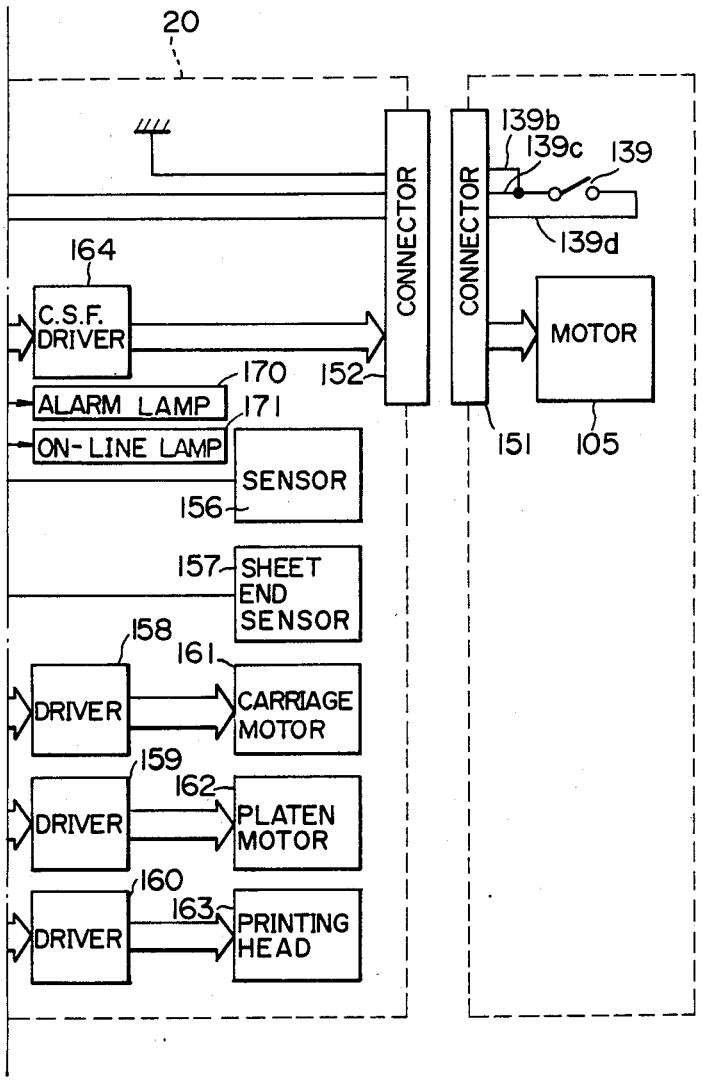

FIG. 15 shows the electric connections among the cut sheet feeder, printer 20 and a host computer. The cut sheet feeder is connected, at a connector 151 thereof, to a connector 152 of the printer, and the motor 105 is controlled by drive signals supplied from the printer. The mode switch 139 is also connected, through connectors, to the printer to transmit the state of the mode switch to the printer. The connections relating to the mode switch 139 are made by three lines including a ground line 139*b*, wherein the state of the mode switch 139 is transmitted by lines 139*b* and 139*d*, while lines 139*b* and 139*c* are used to indicate whether the connector 151 of the cut sheet feeder is connected to the connector 152 of the printer.

In the printer, a central processing unit (CPU) 153 controls drivers 158, 159, 160 etc. according to a program stored in a ROM 154 and in response to the signals from various sensors 156 (carriage position detecting sensor, ribbon and sensor, temperature sensor etc.) and a sheet end sensor 157 to activate a carriage motor 161, a platen motor 162, a printing head 163 thereby printing the data stored in a RAM 155 on a cut sheet on an unrepresented platen. The CPU 153 also detects the state of the mode switch 139 of the cut sheet feeder, and, in case of the automatic feed mode, activates the motor 105 of the cut sheet feeder through a driver 164, thus feeding new cut sheets from the feeder to the printer and introducing the sheets discharged after printing into the cut sheet feeder.

On the other hand, when the mode switch 139 is positioned at the manual feed mode, the CPU 153 does not activate the motor 105 of the cut sheet feeder but executes printing by activating the carriage motor 161, platen motor 162 and printing head 163 in a process in the absence of the cut sheet feeder.

The aforementioned RAM 155 contains not only an area 155*a* for storing data transmitted from the host computer 165 but also areas required for program execution of the CPU 153, such as a line feed counter 155*b* for storing the number of line feeds of the platen motor 162, an RC memory 155*c* for storing the detection of sheet end by the sheet end sensor 157, an SKEY memory 155*d* for storing data indicating that either an LF switch, an FF switch (page feed switch) or a PS (paper set) switch has been actuated, a CSF memory 155*e* for memorizing whether the cut sheet feeder is in operation, a jam memory 155*f* for memorizing whether sheet jamming has taken place etc.

The printer is further provided with an alarm lamp indicating that the absence of cut sheets has been detected by the sheet end sensor 157, and an on-line lamp 171 indicating whether the printer is in an on-line state in which the printer can accept data from the host computer 165, or in an off-line state in which the printer is unable to accept data.

FUNCTION

FIGS. 16A–16C and 17A–17C show operations of the cut sheet feeder and the printer, and the program for executing these operations is stored in the ROM 154 of the printer. In the following there will be explained for respective cases.

Process in response to turning on of power switch

The content of the RAM 155 is initialized when an unrepresented power switch on the right side face of the printer is turned on in a step S1. More specifically, the P-jam memory 155*f*, SKEY memory 155*d*, LF coutner 155*b* and RC memory 155*c* are set to "0" and the CSF memory 155*e* is set to "1" respectively in steps S2–S6. After the initialization, a step S7 detects the output of the sheet end sensor 157 provided in the printer to identify whether cut sheets are present in the printer. The sensor, though not illustrated, is positioned to detect the cut sheet supplied from the cut sheet feeder, immediately before reaching the platen. In case of negative discrimination, i.e. in the presence of cut sheets, the program proceeds to a step S8. The RC memory stores "1" or "0" respectively when the absense or presence of a sheet has been detected, and the discrimination in this case is therefore negative. A succeeding step S9 stores "0" in the CSF memory, which stores "0" or "1" respectively for enabling or disabling the cut sheet feeder. A succeeding step S10 again identifies the state of the RC memory. Since RC memory=0 in this case, an on-line signal is generated in steps S11, S12 to turn on the on-line lamp 171 of the printer to indicate that the printer is ready a printing operation. In this state, the printer awaits the data from the host computer, or preferentially enters an off-line process if the on-line switch is actuated.

On the other hand, in case the step S7 identifies the absence of sheets, there are executed a step S14 for identifying whether the cut sheet feeder is mounted to the printer, a step S15 for identifying whether the cut sheet feeder is in the manual feed mode, and, in case of the automatic feed mode, a step S16 for identifying whether the CSF memory is "0". Since the memory is initialized to "1" at the start of power supply in this case, the program proceeds to a step S17 for setting "1" in the RC memory for indicating the absence of sheets. In case the content of the RC memory is "1", the program proceeds through the steps S8 and S10 to a step S18 to light the alarm lamp 170 in a front panel of the printer, then a step S19 to release an off-line signal and a step S20 to turn off the on-line lamp. Also in the case the on-line switch is actuated in the aforementioned step S13, the program directly jumps to a step S19 without turning on the alarm lamp 170, because the off-line state is merely adopted in this case without any abnormality.

After the off-line process is initiated in this manner, this state is basically retained until either of the LF (line-feed) switch, FF (page-feed) switch and PS (paper set) switch is actuated. Exceptional cases will be explained later.

On-line state

In case the on-line switch is not actuated in the step S13 and data are received from the host computer in a step S21, there are executed a step S22 for identifying whether the data are a line feed signal LF, and a step S23 for identifying whether the data are a page feed signal FF, and, if the discriminations in both steps are negative, a step S24 is executed to activate the carriage motor 161 and the printing head 163 for printing.

On the other hand, in case the step S22 identifies said data as a line-feed signal, a step S25 identifies if the cut sheet feeder is mounted, and, if not, a step S26 rotates the platen motor 162 by a line pitch and a step S27 executes a step increment of the LF counter. On the other hand, if the discrimination in the step S25 is affirmative, a step S28 identifies whether the content of the LF memory is equal to or larger than 100. The formats of the sheet loadable in the cut sheet feeder are such that the sheet end can be sufficiently detected by the sheet end sensor 157 by feeding of 100 lines even for the maximum size. Thus, in case the content of the LF memory is equal to or larger than 100, a step S29 executes another line feed and a step S30 senses the output of the sheet end sensor 157 to identify whether a sheet jamming is present. If the sheet is absent, indicating absence of abnormality, the program returns to the step S6 to repeat the on-line process. On the other hand, if the sheet is present, step S31 to S33 are executed to flash the alarm lamp 170 of the printer and set "1" in the P-jam memory, thus indicating the presence of sheet jamming. The flashing of the alarm lamp 170 continues until the jammed sheet is removed and the sheet end sensor 157 identifies sheet absence, whereupon the program returns to the step S6 while the alarm lamp is continuously lighted.

Upon returning to the step S6 after removal of the jammed sheet, the RC memory is set to "0" and, if the set conditions are not changed, the off-line process is initiated. Then steps S18 to S20 are executed to continue the lighting of the alarm lamp 170, to release an off-line signal instead of the on-line signal and to extinguish the on-line lamp 171, and the program waits in this state until either of the LF, FF and PS switches is actuated.

On the other hand, in case the step S23 identifies the data as the FF signal, a step S34 identifies if the cut sheet feeder is mounted, and, if not, a step S35 is executed to advance the sheet until the end of the page, i.e. the lowest printable line, according to the content of the line feed (LF) memory. In case the cut sheet feeder is mounted and the manual feed mode is not adopted, a step S37 again detects the output of the sheet end sensor 157, and, if the sheet is present, steps S37 to S40 are executed to rotate the platen motor 162 until the content of the LF memory reaches 100 or the sheet end is detected by the sheet end sensor 157 and to increase the content of the LF memory.

Upon detection of the sheet end or the arrival of the content of the LF memory at 100, a step S41 again detects the output of the sheet end sensor 157, and, if the result is negative, indicating the presence of sheet jamming, steps S41 to S44 are repeated to flash the alarm lamp 170 and to set "1" in the P-jam memory. Upon removal of the jammed sheet, the program returns to the step S6 while the alarm lamp 170 continues to be lighted, and the program waits in the off-line state in the same manner as the program return from the step S30.

On the other hand, in the on-line state, the automatic sheet feed operation from the cut sheet feeder to the printer and the sheet discharge operation from the printer to the cut sheet feeder are initiated when a step S71 identifies the absence of sheet. Upon detection of the absence of sheet in the step S71, the program proceeds, according to already set conditions, to a step S42 to set "1" to the CSF memory, and then to a step S43 for identifying whether the content of the P-jam memory is zero. Since the absence of sheet jamming is assumed in this case, the discrimination results are affirmative so that a step S44 rotates the platen motor 162 of the printer by a determined amount to sufficiently discharge the sheet on the platen to the cut sheet feeder, and a step S45 rotates the motor 105 of the cut sheet feeder by a determined amount in the reverse direction to discharge the printed sheet on the sheet tray. Immediately thereafter a step S46 rotates the motor 105 in the forward direction by a determined amount to feed a cut sheet on the sheet feeding tray to the printer. A step S47 rotates the platen motor 162 by an amount corresponding to 16 lines, thereby advancing the cut sheet thus fed to a print start position.

The first sheet feed and sheet discharge are thus achieved in the above-described steps S44 to S47. Then a step S48 detects the output of the sheet end sensor 157 to identify whether the sheet feed and discharge have been correctly effected. If the sheet is detected, indicating a normal state, the program again enters the data processing routine. On the other hand, if the sheet is absent, a step S17 sets "1" in the RC memory and the program enters the off-line process.

Off-line process

In the present embodiment, the off-line state enables an initial sheet setting to the print start position and a sheet setting after a sheet jamming. The off-line state can be divided into a case in which a cut sheet is correctly loaded in the printer and the alarm lamp 170 is turned off, and another case in which the alarm lamp 170 is turned on because of the absence of a cut sheet in the printer or the cut sheet feeder. In case the alarm lamp 170 is turned off, the on-line state can be restored merely by actuating the on-line switch. On the other hand, in case the alarm lamp 170 is turned on, the on-line state can be restored only by sheet setting for example by actuating the FF switch or PS switch.

In the off-line state, upon detection of the actuation of the LF switch in a step S49, steps S50 to S58 are executed to effect a line feed of cut sheet, detection of sheet jamming, storage of sheet jam detection etc. in the same manner as in the case of LF signal detection in the step S22. Then a step S59 sets "1" in the SKEY memory in order to memorize the actuation of the LF key, and the program proceeds to a step S60.

On the other hand, in case the actuation of the FF switch in the off-line state is detected in a step S61, steps S62 to S72 are executed to advance the cut sheet either to the end thereof or until the absence of sheet is detected, or detect sheet jamming and memorize the sheet jamming, in the identical manner as the case when the FF signal is detected in the step S23. Thereafer a step S73 stores "2" in the SKEY memory to memorize the actuation of the FF key, then a step S74 sets "0" in the CSF memory and the program proceeds to a step S60.

On the other hand, in case a step S75 identifies the actuation of the PS switch, a step S76 forcedly rotates the platen motor 162 by an amount corresponding to 16 lines, then a step S77 stores "3" in the SKEY memory to memorize the actuation of the PS switch, then a step S74 sets "0" in the CSF memory and the program proceeds to the step S60.

The step S60 and ensuing steps execute the actual sheet setting, in which the steps S60 and S91 effect processes same as those in the steps S6 to S9, S14 to S17 and S42 to S48. The steps S84 to S87 activate the platen motor 162 and the motor 105 to effect one cycle of sheet feeding and discharge. In the off-line state the sheet feed and discharge are always conducted at this point.

Figure 16A:
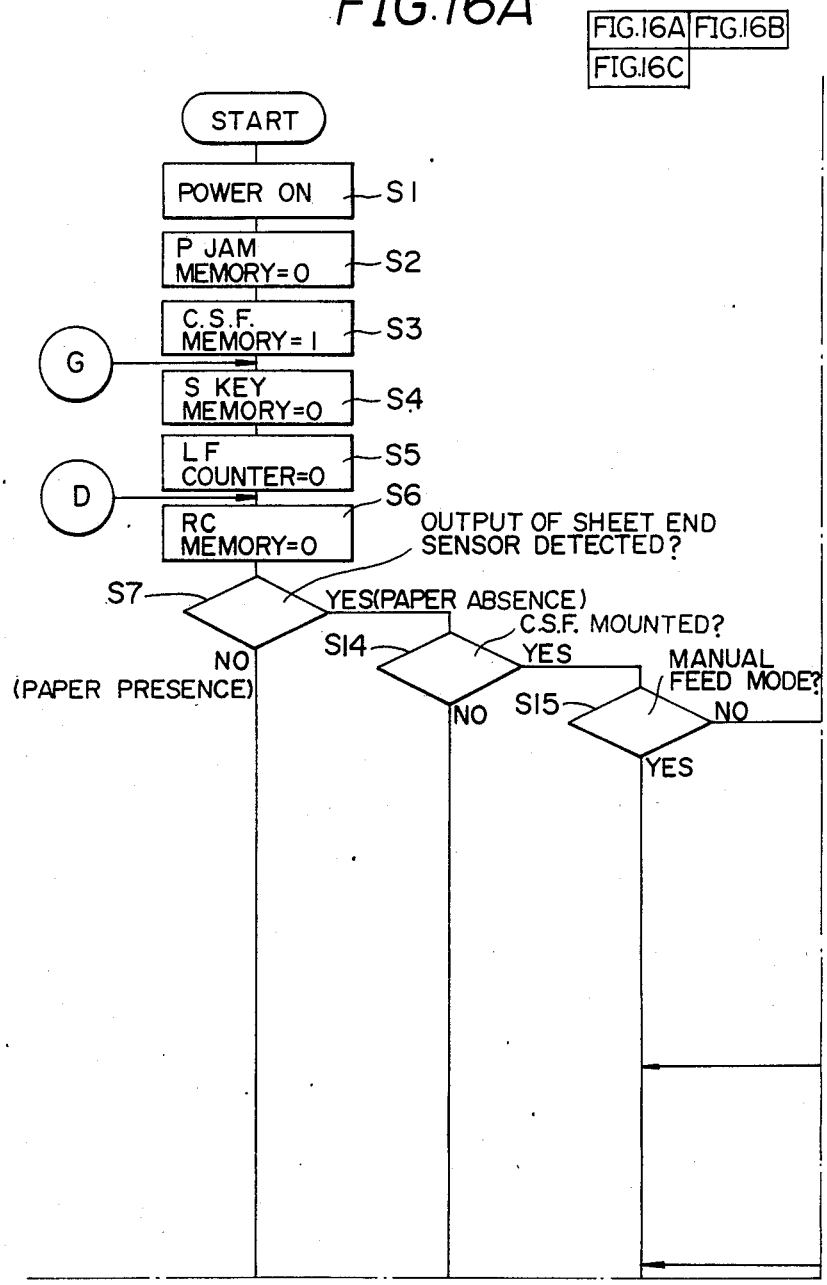
FIGS. 16A to 16C, 17A to 17C, 18A to 18C, and 19A to 19B are flow charts.
Figure 16B:
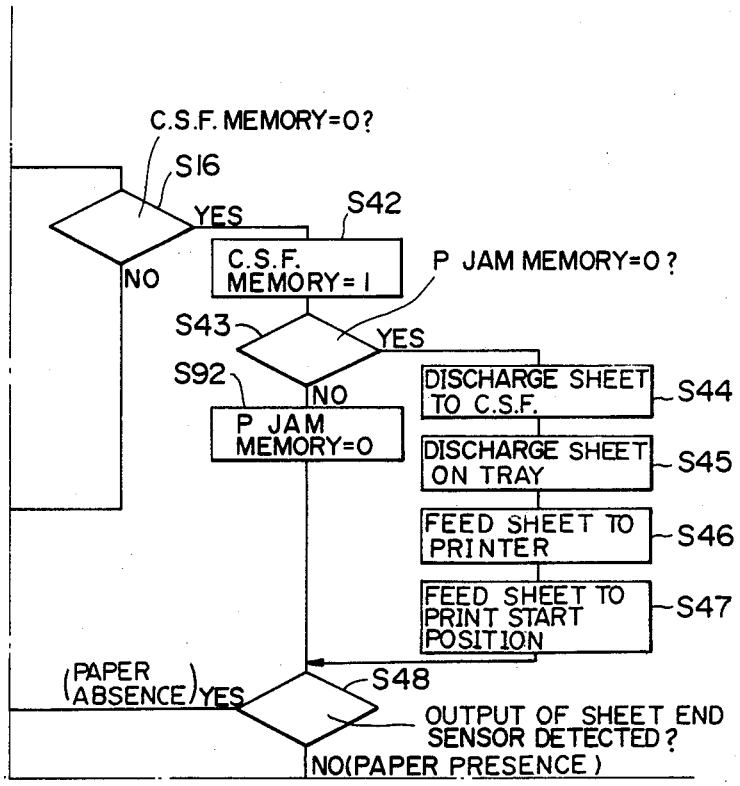
Figure 16C:
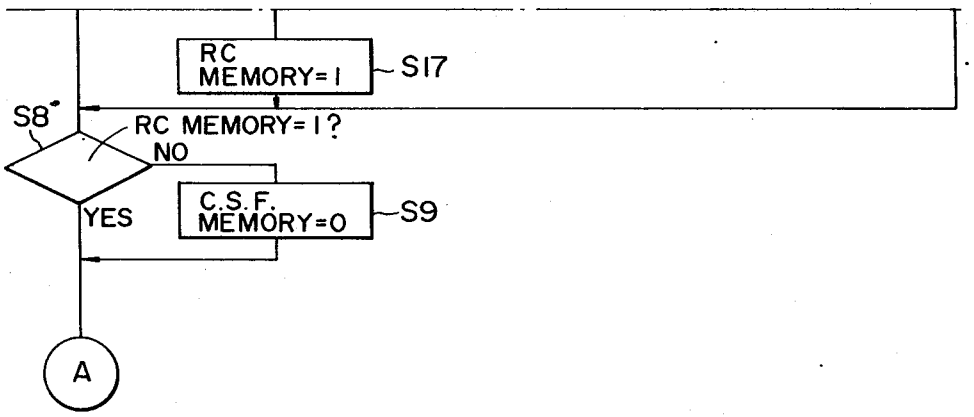
Figure 17A:
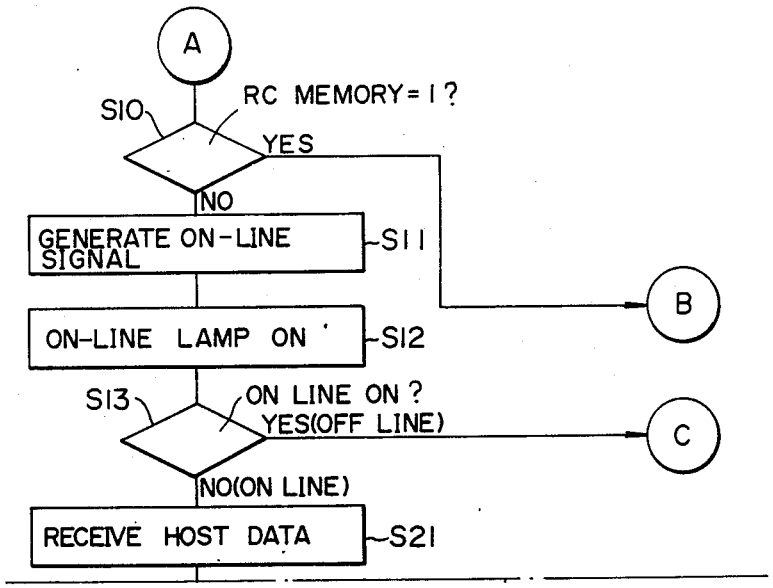
Figure 17B:
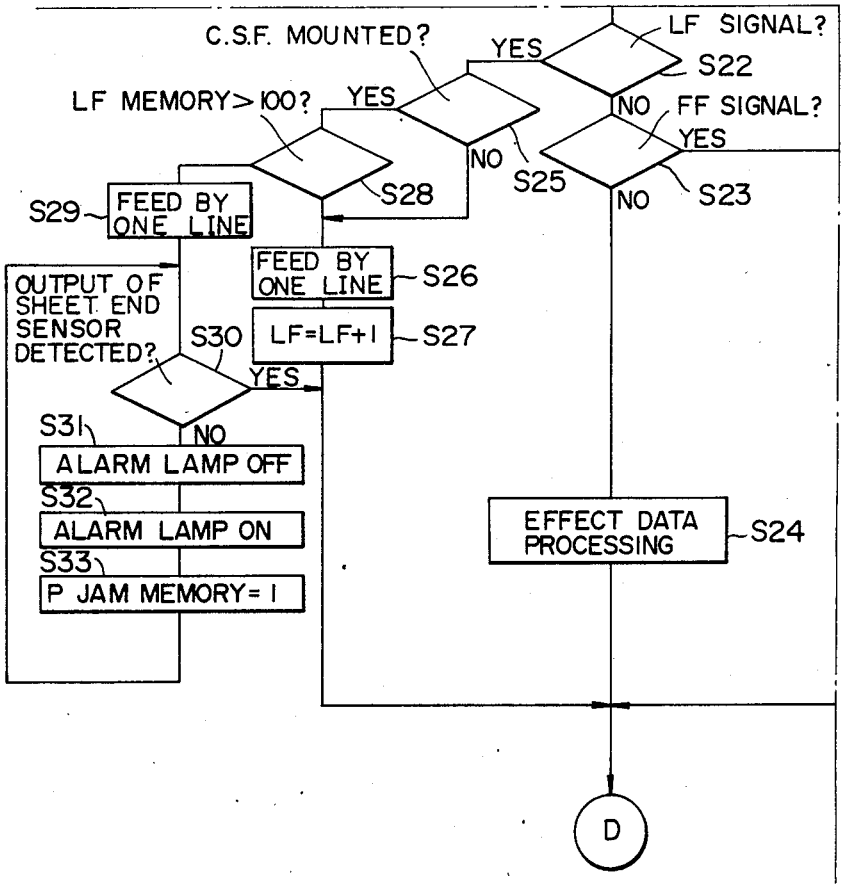
Figure 17C:
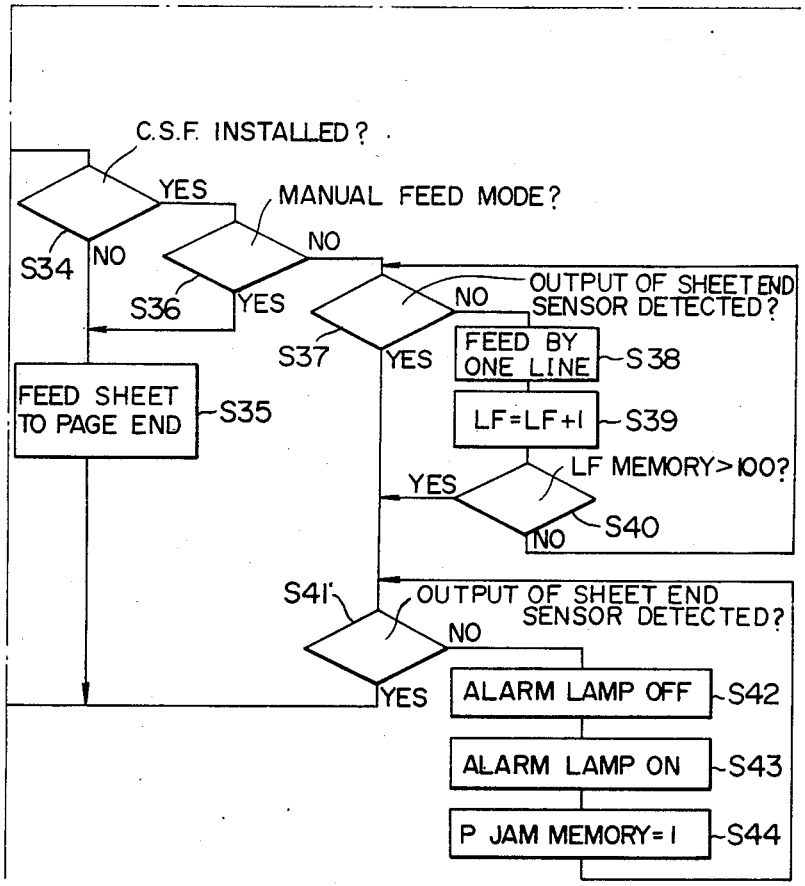
Figure 18A:
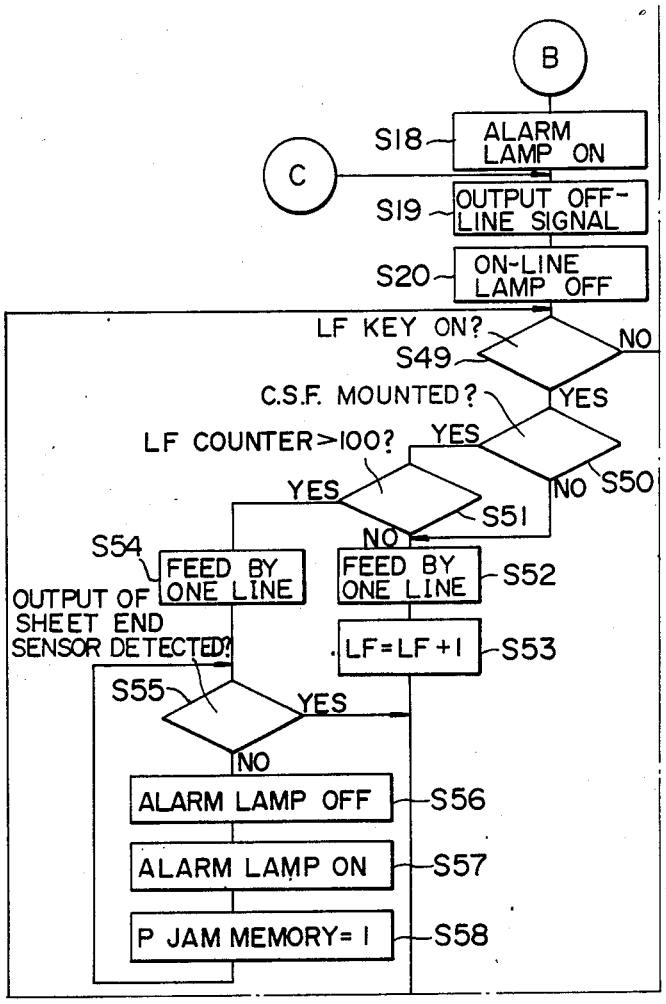
Figure 18B:
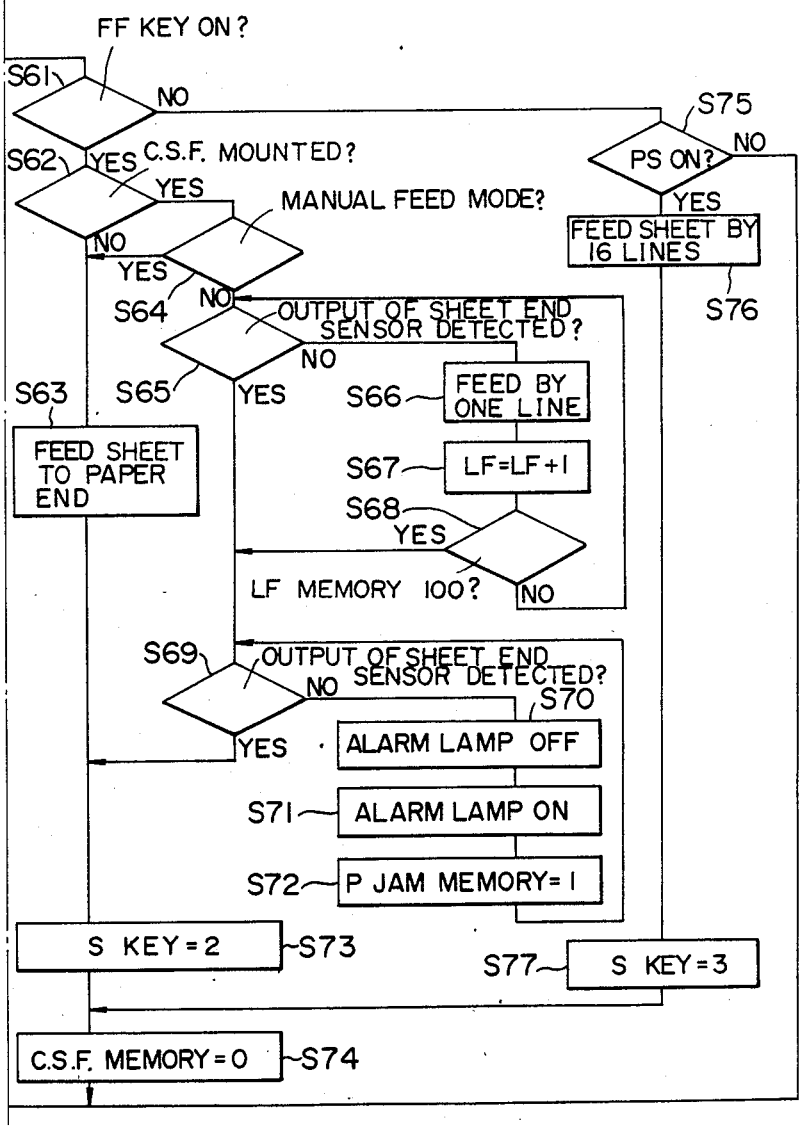
Figure 18C:
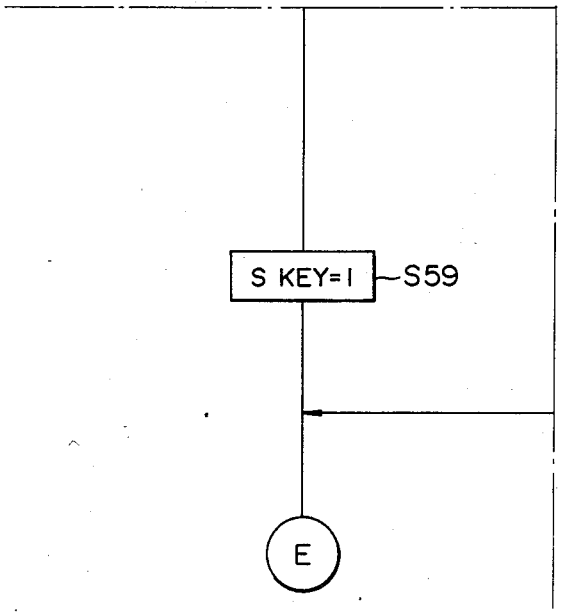
Figures 19A, 19B:
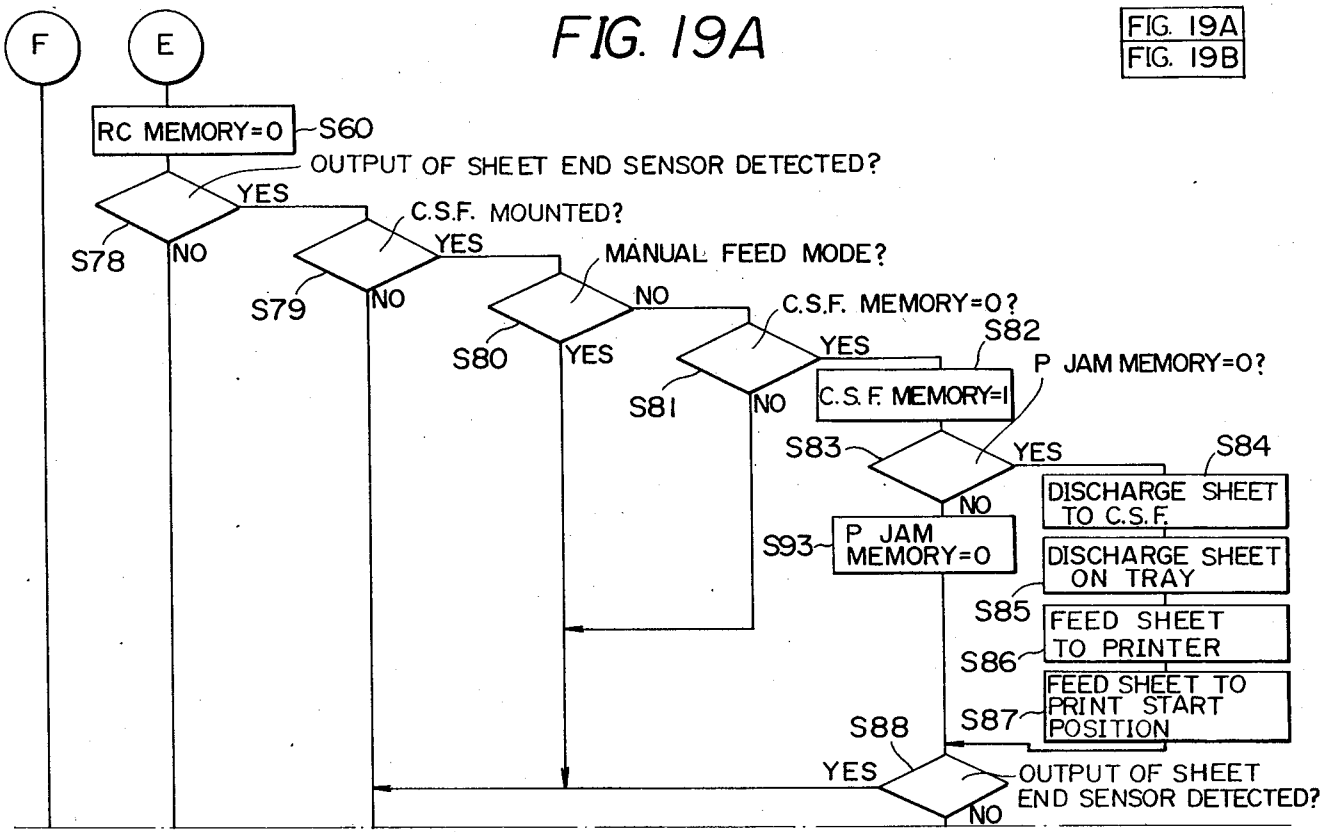
Figure 19B:
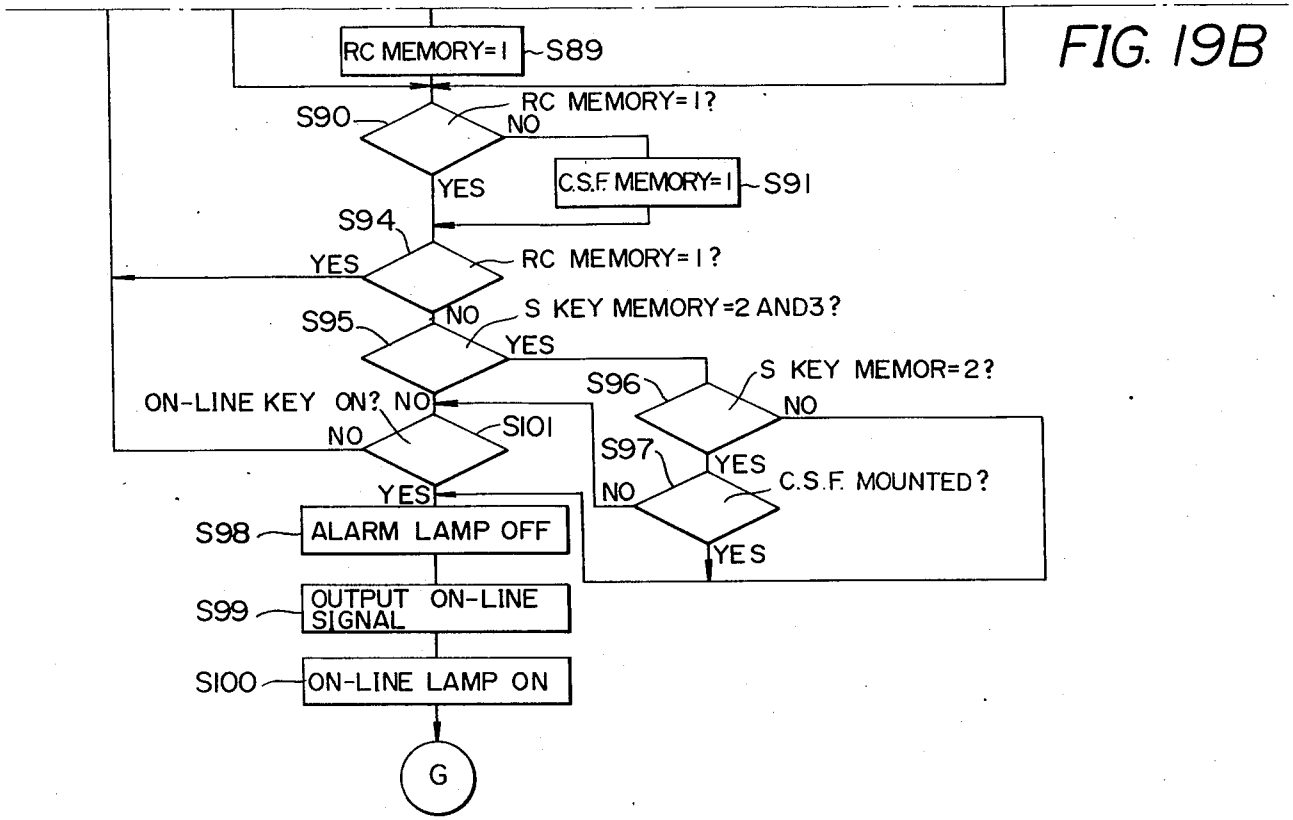

In order to effect the sheet feed and discharge in the steps S84 to S87, there are required conditions that the cut sheet feeder is mounted and the automatic sheet feed mode is adopted, and that the contents of the CSF memory and the P-jam memory are both zero. The conditions CSF memory=0 and P-jam memory=0 are satisfied in the step S60 in one of following four cases:

I. in case the P-jam memory is set to "0" by initialization after the start of power supply, and the CSF memory is set to "0" by the FF switch or PS switch in the step S74;

II. in the on-line state, when the P-jam memory is set to "0" in the step S92 in FIG. 16B after a sheet jamming followed by the removal of the jammed sheet, and the CSF memory is set to "0" in the step S74 by the FF switch or the PS switch;

III. in the off-line state, when the P-jam memory is set to "0" in the step S93 in FIG. 19A after a sheet jamming followed by the removal of the jammed sheet, and the CSF memory is set to "0" in the step S74 by the FF switch or the PS switch; and IV. when the on-line state is forcedly switched to the off-line state by the on-line switch, in which case the step S78 identifies the presence of sheet whereby the program proceeds to the step S90 to dispense with the sheet feed and discharge.

In the above-mentioned case I, II or II, steps S84 to S87 are executed to effect a cycle of sheet feed and discharge, and a step S88 detects the output of the sheet end sensor 157 to identify whether the sheet has been correctly set. If the sheet is absent, a step S89 sets "1" in the RC memory to indicate the absence of sheet, and the program returns to the step S49 through a step S94. Since the CSF memory is set to "1" in the step S82 in this case, the program remains in this state until either of the LF, FF and PS switches is actuated.

On the other hand, a correct sheet setting is identified by the presence of sheet in the step S88, a step S91 sets "1" in the CSF memory and the program proceeds to a step S95. Since the FF or PS switch has been actuated in this case, the program proceeds to a step S96 to identify the actuated switch. If the PS switch has been actuated, there are executed a step S98 to turn off the alarm lamp 170, a step S99 to release the on-line signal and a step S100 to turn on the on-line lamp, and the program returns to the step S4 to initiate the on-line process.

On the other hand, in case the step S96 identifies the actuation of the FF switch, the program proceeds to a step S97 to identify whether the cut sheet feeder is mounted, and, if yes, to the step S98, or, if not, to a step 101 to identify whether the on-line switch has been actuated.

As explained above, in case the PS switch has been actuated and the presence of sheet is detected, the program enters the on-line state, regardless whether the cut sheet feeder is mounted or not. Also in case the FF switch has been actuated and the presence of sheet is detected, the program moves to the on-line state or remains in the off-line state respectively when the cut sheet feeder is mounted or not.

Also in the aforementioned case IV, the actuation of the FF or PS switch causes the discharge of a presently loaded sheet and the feeding of a new cut sheet, but such sheet discharge and feeding do not take place in response to the actuation of the LF switch. However, in case the sheet end is detected in the step S78, a cycle of sheet feed and discharge is automatically conducted because of the conditions CSF memory=0 and P-jam memory=0. Also a cycle of sheet feed and discharge is automatically effected in case the absence of sheet is detected in the step S78. Consequently, in case the operator manually rotates the platen to discharge the cut sheet loaded thereon, a cycle of sheet feed and discharge is automatically effected.

Manual feed mode

In the manual feed mode, all the operations are conducted in the printer alone, and the cut sheet feeder is disabled.

Figure 20A:
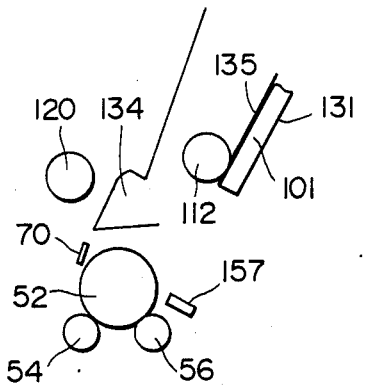
FIGS. 20A to 20H are schematic views showing a feed process for a cut sheet.
Figure 20B:
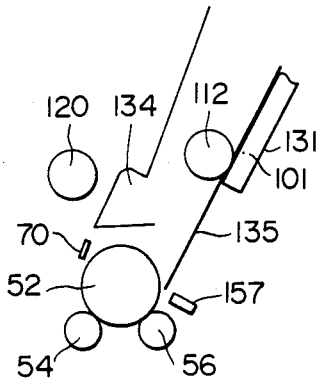
Figure 20C:
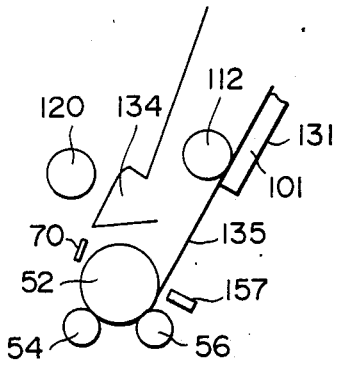
Figure 20D:
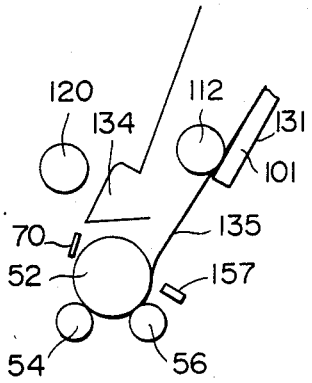
Figure 20E:
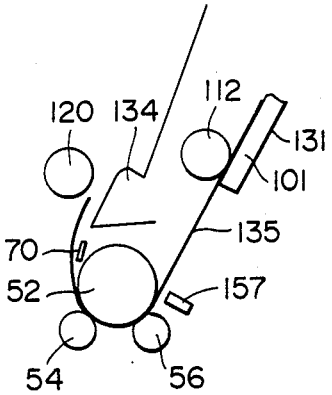
Figure 20F:
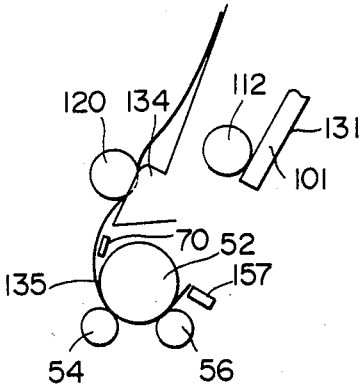
Figure 20G:
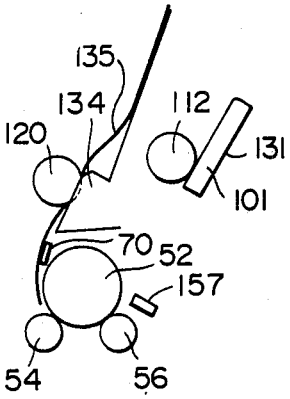
Figure 20H:
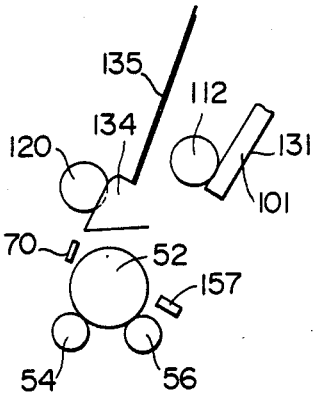
Figure 21:
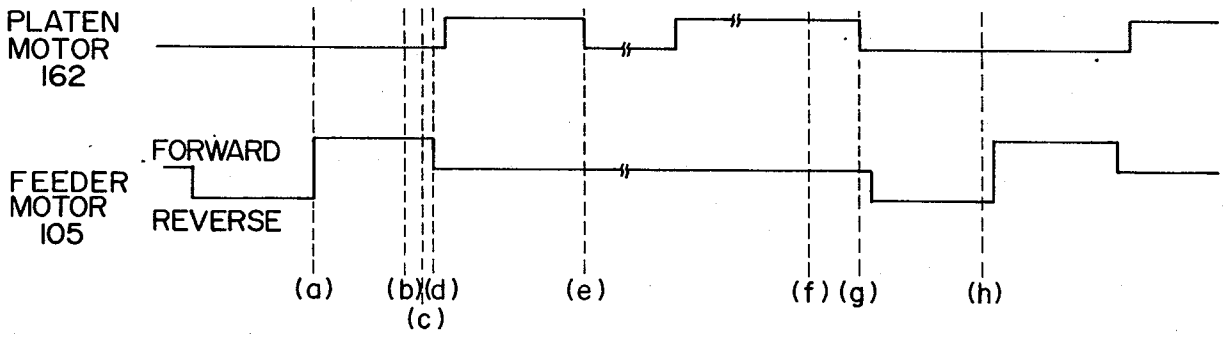
FIG. 21 is a timing chart.

In the foregoing, the function of the present embodiment has been detailedly explained. However, for the purpose of helping further understanding, FIGS. 20A to 20H and 21 show the relationship among the functions of the platen motor 162 and feeder motor 105, and the position of a cut sheet. When a new cut sheet 135 is fed to the printer (FIG. 20A), the feeder motor 105 is at first rotated in the reverse direction and then in the forward direction, whereby the cut sheet is supplied to the platen 52. The leading end of the cut sheet passes the position of the sheet end sensor 157 (FIG. 20B), and then reduces a position between the platen 52 and the pinch roller 56 (FIG. 20C). Subsequently the platen 52 is further rotated by a small amount to form a loop in the leading end portion of the cut sheet (FIG. 20D). Then the feeder is stopped and the platen motor 162 is rotated by a determined amount to feed the cut sheet to the print start position (FIG. 20E). subsequently the printing operation is initiated, with the advancement of the cut sheet by the rotation of the platen 52, and the end of the cut sheet 135 is detected by the sheet end sensor 157 (FIG. 20F). From this position the platen 52 is further rotated until the end of the cut sheet 135 is released from the platen 52 and the pinch roller 54 (FIG. 20G). Then the platen 52 is stopped and the sheet discharge roller 120 is activated, thus discharging the cut sheet completely to the discharged sheet tray (FIG. 20H).

What is claimed is:

1. An automatic cut sheet feeding system for use with a recording apparatus, comprising:
   - a reversible motor;
   - means for storing plural cut sheets;
   - a sheet feeding roller disposed at a fixed position to be always in contact with a cut sheet stored in the storing means, the sheet feeding roller advancing the cut sheet by forward rotation of the motor;
   - a discharge roller provided at an end of a rockable member which is rockably disposed on a rotation shaft of said feeding roller, the rocking member being moved by reverse rotation of the motor to approach the discharge roller to the cut sheet and being moved by forward rotation of the motor to move the discharge roller away from the cut sheet, and said discharge roller being rotated at least by reverse rotation of the motor to discharge the cut sheet.

2. An automatic cut sheet feeding system according to claim 1, wherein said discharging roller rotates in opposite directions upon forward and reverse rotations of the motor, respectively.

3. An automatic cut sheet feeding system according to claim 1, wherein said discharge roller is so moved as to contact with the cut sheet by the reverse rotation of said motor, thereby discharging the cut sheet.

4. An automatic cut sheet feeding system according to claim 1, further comprising advancing means for advancing the cut sheet in front of the recording apparatus, independently from said feed means.

5. An automatic cut sheet feeding system for use with a recording apparatus comprising:
   - means for automatically feeding a cut sheet to the recording apparatus;
   - a case for said automatic cut sheet feeding system;
   - a lid member disposed on said case to be freely moved between a closed and opened state, said lid member, when opened, forming an opening for manually feeding the cut sheet to the recording apparatus, and at this time the recording apparatus being located on an extension of a front face of said lid member, and lid member functioning as a guide for manually feeding the cut sheet; and
   - control means for selecting a feed mode from a group of feed modes consisting of an automatic feed mode and a manual feed mode by detecting the state of said lid member and activating said feed means in the automatic feed mode.

6. An automatic cut sheet feeding system according to claim 5, wherein said case accommodates a stack of cut sheets, and wherein said lid member serves also as a cover for protecting the cut sheets.

7. An automatic cut sheet feeding system according to claim 5, further comprising means for advancing the cut sheet to the recording apparatus independently from said feed means.

8. A detachable automatic cut sheet feeder for a recording apparatus, comprising:

a reversible motor;

a first storing means for storing plural cut sheets;

a feeding roller disposed at a fixed position to be always in contact with the cut sheet in the first storing means;

a second storing means for storing recorded cut sheets;

a discharging roller disposed at an end of a rockable member rotatably disposed on a rotation shaft of said feeding roller, said rockable member being moved by reverse rotation of the motor to bring the feeding roller toward the cut sheet and being moved upon forward rotation of the motor to move the discharging roller away from the cut sheet, and the discharging roller being rotated at least by reverse rotation of the motor to discharge the cut sheet advanced from said recording apparatus by reverse rotation of the motor to said second storing means.

9. A detachable automatic cut sheet feeder according to claim 8, wherein asid discharging roller is rotated in opposite dirctions upon forward and reverse rotations of the motor, respectively.

10. An automatic cut sheet feeder for a recording apparatus having a platen, comprising:

means for feeding a cut sheet to the recording apparatus;

a case for said cut sheet feeder;

a lid member disposed on said case to be freely opened and closed, said lid member, when opened forming an opening for manually feeding the cut sheet to the platen of the recording apparatus, and at this time the platen being located on an extension of a front face of said lid member, and said lid member functioning also as a guide for manually feeding the cut sheet; and switching means being switched over between ON and OFF in interlocked with opening and closing of said lid member and informing information in its ON and OFF states to the recording apparatus.

11. An automatic cut sheet feeder according to claim 10, wherein said case accommodates a stack of cut sheets, and wherein said lid member serves also as a cover for protecting the cut sheets.

12. An automatic cut sheet feeder according to claim 10, further comprising means for advancing the cut sheet to the recording apparatus independently from said feeding means.

* * * * *

UNITED STATES PATENT AND TRADEMARK OFFICE

CERTIFICATE OF CORRECTION

PATENT NO. : 4,699,366

DATED : October 13, 1987

INVENTOR(S) : MAKOTO KASHIMURA, ET AL.

It is certified that error appears in the above-identified patent and that said Letters Patent is hereby corrected as shown below:

In The Headnote,

[56] "4,071,232 1/1978 Fujmoto .....271/265" should read --4,071,232 1/1978 Fujimoto .....271/265--.

Column 1, line 21, "a" should read --the--.

Column 2, line 11, "sheet or sheets" should read --sheets or sheet--;

line 44, "invenion" should read --invention--.

Column 3, line 42, "insuring" should read --ensuring--;

line 43, "wherein;" should read --wherein:--.

Column 5, line 17, "56, 56" should read --56, 54--.

Column 6, line 46, "it" should read --at--.

Column 7, line 5, "counter" should read --counter- --;

line 11, "shown" should read --is shown--.

UNITED STATES PATENT AND TRADEMARK OFFICE

CERTIFICATE OF CORRECTION

PATENT NO. : 4,699,366

DATED : October 13, 1987

INVENTOR(S) : MAKOTO KASHIMURA, ET AL.

It is certified that error appears in the above-identified patent and that said Letters Patent is hereby corrected as shown below:

Column 9, line 57, "coutner" should read --counter--;

line 68, "absense" should read --absence--.

Column 10, line 9, "ready a" should read --ready for a-- line 60, "a" should be deleted.

Column 13, line 4, "or II" should read --or III--;

line 28, "101" should read --S101--.

Column 14, line 3, "feeder is" should read --feeder motor is--;

line 5, "subsequently" should read --Subsequently--;

line 58, "and lid" should read --and said lid--.

Column 15, line 28, "asid" should read --said--.

UNITED STATES PATENT AND TRADEMARK OFFICE

CERTIFICATE OF CORRECTION

PATENT NO. : 4,699,366 Sheet 3 of 3

DATED : October 13, 1987

INVENTOR(S) : MAKOTO KASHIMURA, ET AL.

It is certified that error appears in the above-identified patent and that said Letters Patent is hereby corrected as shown below:

Column 16, line 1, "dirctions" should read --directions--.

Signed and Sealed this

Seventeenth Day of May, 1988

*Attest:*

DONALD J. QUIGG

*Attesting Officer*

*Commissioner of Patents and Trademarks*